US009174098B2

(12) United States Patent
Hayase et al.

(10) Patent No.: US 9,174,098 B2
(45) Date of Patent: Nov. 3, 2015

(54) GOLF CLUB HEAD

(71) Applicant: DUNLOP SPORTS CO. LTD., Kobe-shi, Hyogo (JP)

(72) Inventors: Seiji Hayase, Kobe (JP); Masahide Onuki, Kobe (JP); Akio Yamamoto, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 13/644,997

(22) Filed: Oct. 4, 2012

(65) Prior Publication Data

US 2013/0109502 A1 May 2, 2013

(30) Foreign Application Priority Data

Oct. 28, 2011 (JP) ..... 2011-236582

(51) Int. Cl.
*A63B 53/04* (2015.01)
*A63B 59/00* (2015.01)
*A63B 71/06* (2006.01)

(52) U.S. Cl.
CPC ..... *A63B 53/0466* (2013.01); *A63B 53/04* (2013.01); *A63B 2053/0408* (2013.01); *A63B 2053/0433* (2013.01); *A63B 2053/0437* (2013.01); *A63B 2059/0003* (2013.01); *A63B 2071/0633* (2013.01); *A63B 2209/023* (2013.01); *A63B 2225/01* (2013.01)

(58) Field of Classification Search
CPC ..... A63B 53/0466; A63B 2209/023
USPC ..... 473/345, 347, 348
See application file for complete search history.

(56) References Cited

U.S. PATENT DOCUMENTS

| | | | | |
|---|---|---|---|---|
| 6,354,963 | B1 | 3/2002 | Kodama et al. | |
| 2005/0026721 | A1 | 2/2005 | Imamoto et al. | |
| 2005/0209022 | A1 | 9/2005 | Yamamoto | |
| 2005/0209024 | A1 | 9/2005 | Oyama | |
| 2005/0215353 | A1 * | 9/2005 | Schweigert et al. | 473/349 |
| 2005/0245328 | A1 | 11/2005 | Kouno et al. | |
| 2009/0139643 | A1 | 6/2009 | Kouno et al. | |
| 2009/0176600 | A1 * | 7/2009 | Kouno et al. | 473/348 |

FOREIGN PATENT DOCUMENTS

| | | | |
|---|---|---|---|
| CN | 1669604 | A | 9/2005 |
| JP | 11-290486 | A | 10/1999 |
| JP | 2003-320060 | A | 11/2003 |
| JP | 2005-253606 | A | 9/2005 |
| JP | 2006-261582 | A | 9/2005 |
| JP | 2006-296500 | A | 11/2006 |

* cited by examiner

*Primary Examiner* — Michael Dennis
(74) *Attorney, Agent, or Firm* — Birch, Stewart, Kolasch & Birch, LLP

(57) ABSTRACT

A golf club head 2 is provided with a head body h1 and a CFRP member 16. The CFRP member 16 constitutes at least a part of a crown 6 or at least a part of a sole 8. The CFRP member 16 has a UD lamination part 18 having laminated UD layers. Orientation of a fiber is substantially set to three directions in the UD lamination part 18. When the three directions are a first direction, a second direction, and a third direction, preferably, an angle of the second direction to the first direction is substantially +60 degrees, and an angle of the third direction to the first direction is substantially −60 degrees. Preferably, the UD lamination part 18 has a lamination symmetrical property in a fiber orientation angle. Preferably, the number of layers of the UD lamination part 18 is 5 or greater and 12 or less.

13 Claims, 20 Drawing Sheets

GOLF CLUB HEAD

The present application claims priority on Patent Application No. 2011-236582 filed in JAPAN on Oct. 28, 2011, the entire contents of which are hereby incorporated by reference.

BACKGROUND OF THE INVENTION

1. Field of the Invention

The present invention relates to a golf club head. In particular, the present invention relates to a golf club head having a CFRP member.

2. Description of the Related Art

In a golf club head, a coefficient of restitution and a volume of the head are regulated by the rule. In respect of a swing balance, a weight of the head is restricted. Furthermore, in respect of practicality, high strength is required. The regulation and the restriction complicate the design of a head having enhanced performance.

In order to improve the performance of the head, a head using CFRP is known. The CFRP means carbon fiber reinforced plastic. The CFRP can have specific strength higher than that of titanium. An excess weight can be created by using the CFRP. A position of a center of gravity of the head can be changed by redisposing the excess weight. The excess weight can improve a degree of freedom of the design of the head.

Japanese Patent Application Publication No. 4222118 (US2005/0026721) discloses a hollow golf club head having a front face body made of an integral titanium-based metal material, a metal sole plate, and a fiber-reinforced resin body. Paragraph [0036] discloses a sheet having a carbon fiber obliquely oriented by 60 degrees in a clockwise direction to a toe-heel direction, and a sheet having a carbon fiber obliquely oriented by 60 degrees in a counterclockwise direction to the toe-heel direction. In FIG. 6 of Japanese Patent Application Laid-Open No. 2005-253606, a laminate oriented in four directions is disclosed. Japanese Patent Application Laid-Open No. 2005-312646 (US2005/0245328, US2009/0139643, US2009/0176600) discloses a constitution in which fibers are crossed at the angle of 30 to 90 degrees. Japanese Patent Application Laid-Open No. 2005-296626 (US2005/0209022) discloses a resin member including a 0° direction prepreg of which a fiber substantially makes an angle of 0 degree to a front-back direction line of a head, and a 90° direction prepreg of which a fiber substantially makes 90 degrees to the front-back direction line of the head.

SUMMARY OF THE INVENTION

The CFRP has a damping ratio (loss factor) greater than that of a metal. For this reason, a hitting sound is apt to be shortened. Furthermore, the primary peak frequency of the hitting sound tends to be low in the head using the CFRP. A short hitting sound having a low frequency is apt to give a poor impression to a golf player. The hitting sound can have an influence on psychology and a swing of the golf player. The hitting sound is preferably improved.

It is an object of the present invention to provide a golf club head having a CFRP member and having an excellent hitting sound.

A golf club head according to the present invention is provided with a head body and a CFRP member. The CFRP member constitutes at least a part of a crown or at least a part of a sole. The CFRP member has a UD lamination part having laminated UD layers. Orientation of a fiber is substantially set to three directions in the UD lamination part.

The three directions are a first direction, a second direction, and a third direction. At this time, preferably, an angle of the second direction to the first direction is substantially +60 degrees, and an angle of the third direction to the first direction is substantially −60 degrees.

Preferably, the UD lamination part has a lamination symmetrical property in an orientation angle of the fiber.

Preferably, the number of layers of the UD lamination part is 5 or greater and 12 or less.

Preferably, the CFRP member constitutes at least a part of the crown.

Preferably, a volume of a head is equal to or greater than 400 cc. Preferably, a weight of the head is equal to or less than 200 g. Preferably, a lateral moment of inertia is equal to or greater than 4600 $g \cdot cm^2$.

A golf club head having a CFRP member and having an excellent hitting sound can be obtained.

DESCRIPTION OF THE PREFERRED EMBODIMENTS

Hereinafter, the present invention will be described in detail based on preferred embodiments with appropriate references to the accompanying drawings.

In the present application, a base state, a toe-heel direction, and a face-back direction FB are defined.

[Base State]

The base state is a state where a head is placed on a level surface h at a predetermined lie angle and real loft angle. In more detail, the base state is the following state. The head is grounded on the level surface h in a state where a center axis line z of a shaft, hole of the head is provided in an optional perpendicular surface VP1, the center axis line z is inclined to the level surface h at the lie angle, and a face surface is inclined to the perpendicular surface VP1 at the real loft angle. The perpendicular surface VP1 is a plane parallel to a vertical line.

[Toe-Heel Direction]

In the head in the base state, a direction parallel to an intersection line of the perpendicular surface VP1 and the level surface h is the toe-heel direction.

[Face-Back Direction]

In the head in the base state, a direction perpendicular to the toe-heel direction and parallel to the level surface h is the face-back direction.

Figure 1:
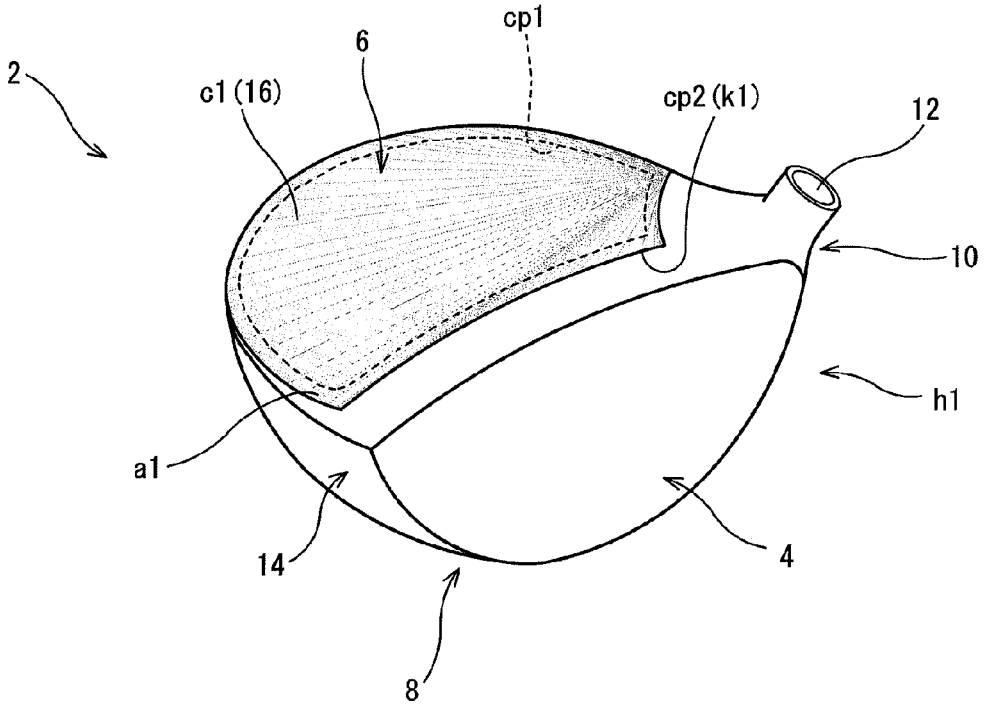
FIG. 1 is a perspective view of a head according to an embodiment of the present invention.

FIG. 1 is a perspective view of a head 2 according to an embodiment of the present invention. The head 2 is a wood type head. The head 2 has a face 4, a crown 6, a sole 8, and a hosel 10. The hosel 10 has a shaft hole 12. The head 2 has a hollow structure. Furthermore, the head 2 has a side 14.

The head 2 is formed by joining a plurality of members. The head 2 of the embodiment is formed by joining a head body h1 and a crown member c1. The head 2 may be formed by joining the head body h1 and a sole member.

Furthermore, the head body h1 may be formed by joining a plurality of members. For example, the head body h1 may be formed by a first member having an opened face portion and a second member forming the face.

Figure 2:
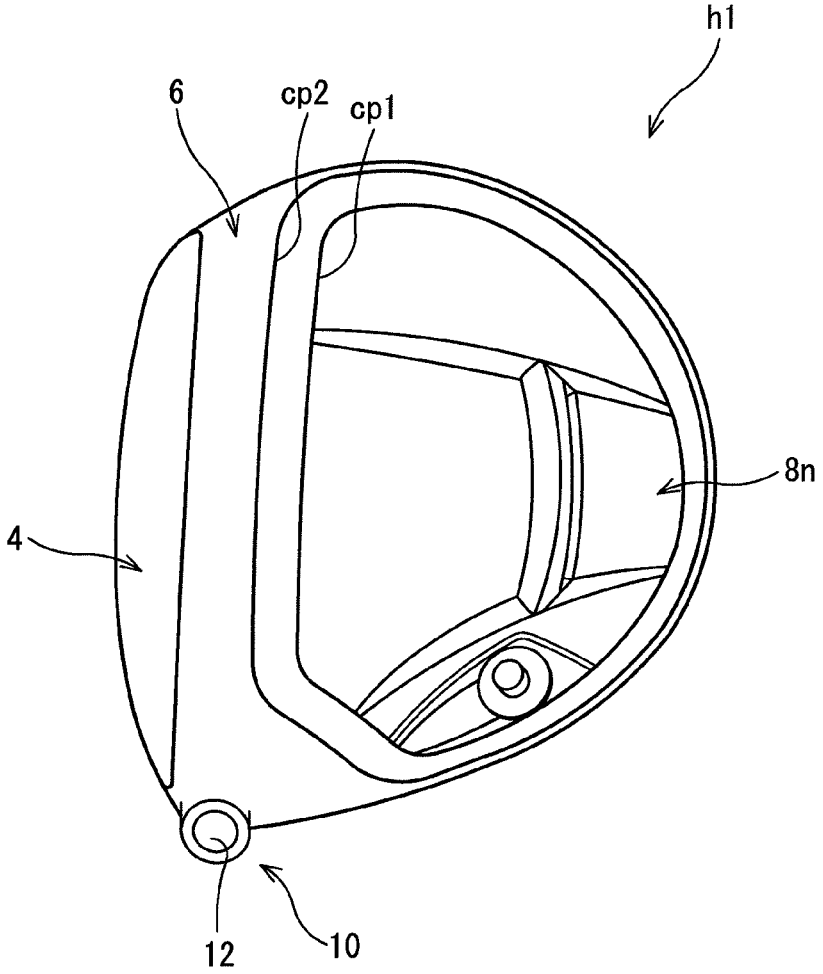
FIG. 2 is a plan view showing a head body used in the head of FIG. 1.

FIG. 2 is a plan view of the head body h1 viewed from a crown side. In the embodiment, the head body h1 has a crown opening cp1. The crown member c1 is not shown in FIG. 2. Therefore, in FIG. 2, an inner surface 8*n* of the sole 8 are drawn. In the head 2, the crown opening cp1 is closed by the crown member c1. Therefore, in the head 2, the inner surface 8*n* of the sole 8 are not visually recognized.

As shown in FIG. 2, the head body h1 has a level difference part cp2 provided around the crown opening cp1. The height of the level difference of the level difference part cp2 is substantially equal to the thickness of the crown member c1. Therefore, on the outer surface of the head 2, a boundary line k1 between the crown member c1 and the head body h1 has no level difference.

The crown member c1 forms a part of the crown 6. The crown member c1 forms the most of the crown 6. The crown member c1 occupies 50% or greater of the area of the crown 6.

A method for joining the crown member c1 and the head body h1 is adhesion. An adhesive is used for the adhesion. A region between the crown opening cp1 and the level difference part cp2 is an overlapped part a1. In the overlapped part a1, the crown member c1 and the head body h1 are overlapped. In the overlapped part a1, the crown member c1 and the head body h1 are joined. The overlapped part a1 is provided over the whole circumference of the crown opening cp1.

The crown member c1 is not backed up by the head body h1 in a portion other than the overlapped part a1. In the portion other than the overlapped part a1, the crown member c1 independently forms the crown 6.

The crown member c1 is formed by CFRP. The CFRP means carbon fiber reinforced plastic. In the embodiment, the crown member c1 is a CFRP member 16.

In the present application, a portion including only the CFRP member is referred to as a CFRP single part. In the crown member c1, a portion except the overlapped part a1 is the CFRP single part. In other words, the CFRP single part is a portion inside the crown opening cp1. The CFRP single part is not backed up by the head body h1. The CFRP single part occupies 50% or greater of the area of the crown 6.

The CFRP member 16 may be disposed on a portion other than the crown 6. The CFRP member 16 may be provided in the crown 6 and the side 14. The CFRP member 16 may be provided in the crown 6, the side 14, and the sole 8. The CFRP member 16 may be provided in the sole 8. The CFRP member 16 may be provided in the sole 8 and the side 14.

The CFRP member 16 is a laminate. The CFRP member 16 is formed by a plurality of layers. All the layers are formed by the CFRP.

A prepreg is used to produce the CFRP member 16. The prepreg has a matrix resin and a carbon fiber. One layer is formed by one prepreg. The laminate is formed by superposing a plurality of prepregs.

Figure 3:
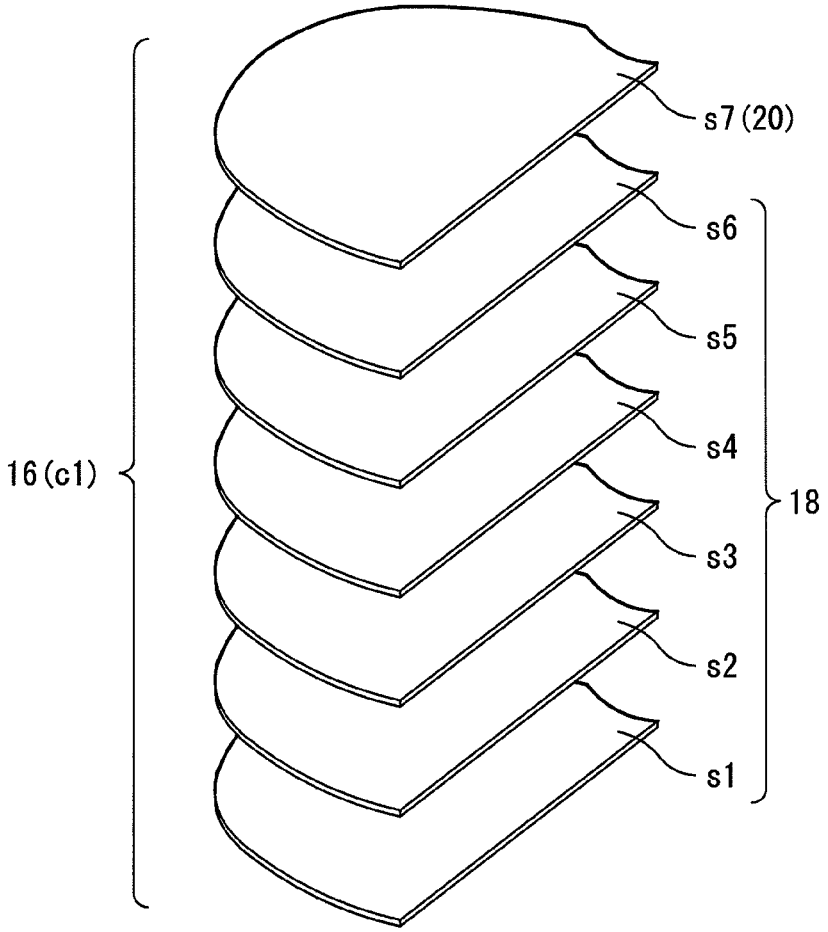
FIG. 3 is an exploded perspective view of a CFRP member used in the head of FIG. 1.
Figure 4:
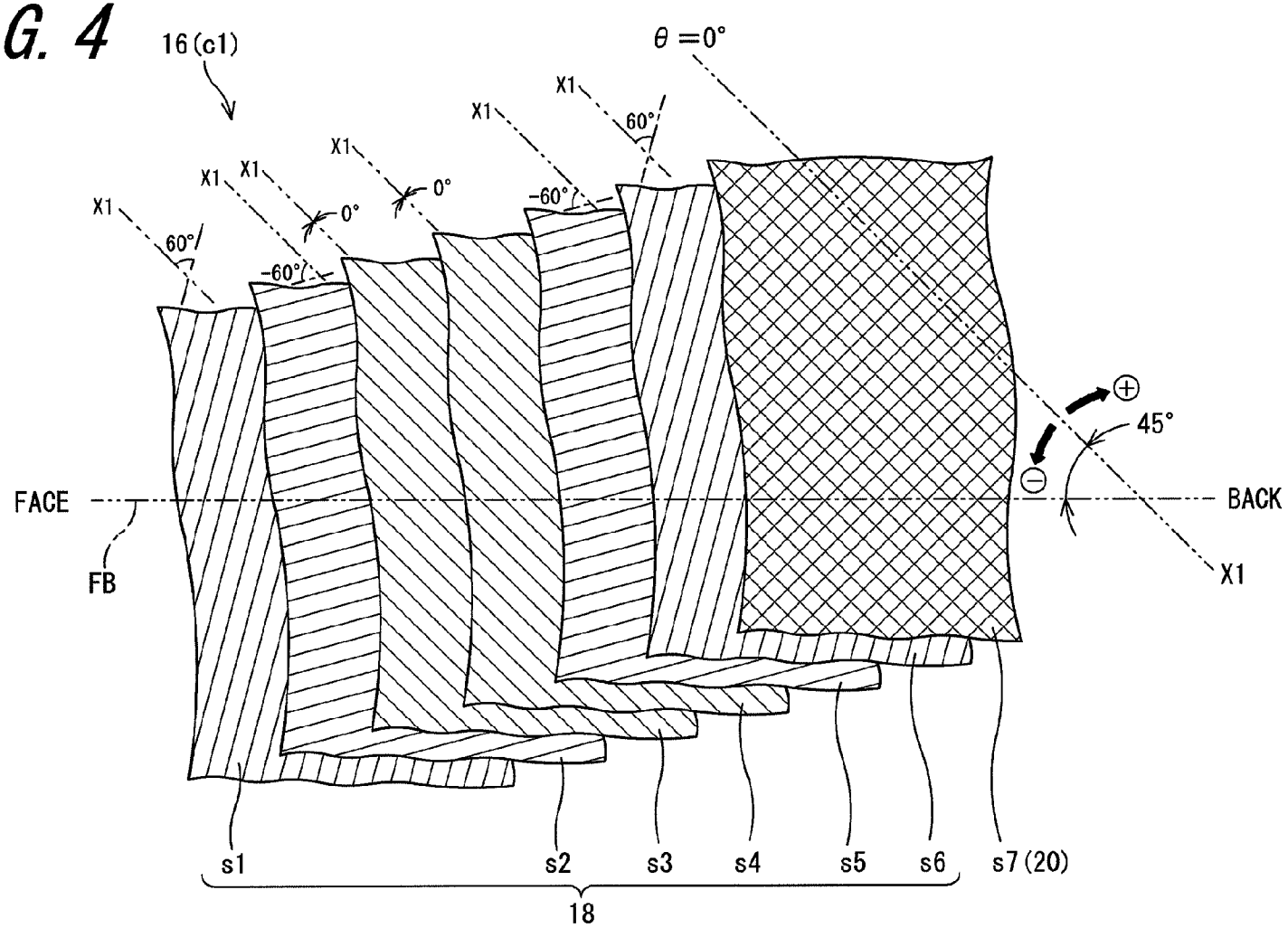
FIG. 4 shows orientation of a fiber in each layer of the CFRP member of FIG. 3.

FIG. 3 is an exploded perspective view showing the lamination of the CFRP member 16 (crown member c1). FIG. 4 is a plan view showing the lamination of the CFRP member 16. The CFRP member 16 has seven layers. The CFRP member 16 has a first layer s1, a second layer s2, a third layer s3, a fourth layer s4, a fifth layer s5, a sixth layer s6, and a seventh layer s7. The first layer s1 is an innermost layer. The first layer s1 forms the inner surface of the head 2. In other words, the first layer s1 is brought into contact with the hollow part of the head 2. The seventh layer s7 is an outermost layer. The seventh layer s7 forms the outer surface of the head 2. In respect of an appearance, the outer surface of the seventh layer s7 (outermost layer) is usually polished. Furthermore, coating is usually applied to the polished surface. In the embodiment, a coating film is formed on the outside of the seventh layer s7. Each layer is flat in FIG. 3. However, in the actual head 2, each layer forms a curved surface. In FIG. 3, the thickness of each layer is drawn to be thicker than in reality.

A metal mold for molding the CFRP member 16 is prepared to produce the CFRP member 16. As shown in FIG. 3, the plurality of prepregs is cut. Next, while these prepregs are superposed, the prepregs are set in the metal mold. Next, the prepregs are heated and pressurized. The matrix resin is cured by the heating, to mold the CFRP member 16.

The CFRP member 16 has a UD lamination part 18 and a cloth layer 20. The UD lamination part 18 is a portion having laminated UD layers. The term "UD" stands for uni-direction. In the UD layer, orientation of a fiber is to one direction. The UD layer is formed by a UD prepreg. In the cloth layer 20, orientation of a carbon fiber is generally set to two directions. The typical cloth layer 20 has a carbon fiber fabric. The typical cloth layer 20 is formed by a fabric prepreg.

In the embodiment, the first layer s1 to the sixth layer s6 are included in the UD lamination part 18. The seventh layer s7 is the cloth layer 20. The cloth layer 20 is located outside the UD lamination part 18. The UD lamination part 18 and the cloth layer 20 are brought into contact with each other.

[Lamination Symmetrical Property]

The term "lamination symmetrical property" is used in the present application. The term is independently defined in the present application. The lamination symmetrical property is defined in the UD lamination part 18. The lamination symmetrical property can be defined for every specification. Examples of the specification include an orientation angle of a fiber, a layer thickness, a carbon fiber kind, a fiber content, and a prepreg kind.

The lamination symmetrical property means that a specification in an outer $n^{th}$ layer counted from a neutral plane is substantially the same as a specification in an inner $n^{th}$ layer counted from the neutral plane, in all n. n is an integer equal to or greater than 1.

Figure 5A:
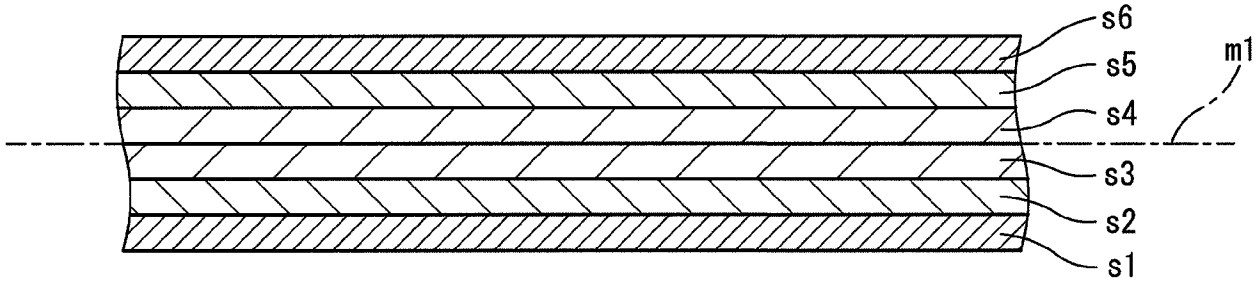
FIGS. 5A and 5B are cross sectional views describing a lamination symmetrical property.
Figure 5B:
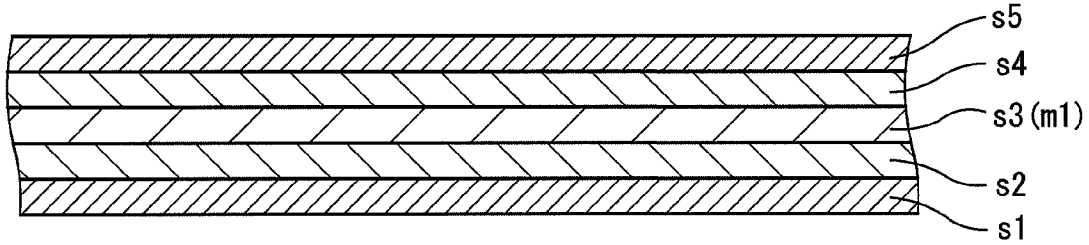

FIGS. 5A and 5B describe the lamination symmetrical property. FIGS. 5A and 5B show cross sectional views of the UD lamination part. In the cross sectional views, each layer is flat. However, in fact, each layer forms a curved surface.

When the number N of layers of the UD lamination part is even, the neutral plane means a boundary between a [N/2]-th layer and a [(N/2)+1]-th layer. For example, as shown in FIG. 5A, when the number N of layers of the UD lamination part is 6, a neutral plane m1 is a boundary between the third layer s3 and the fourth layer s4. The embodiment of FIG. 5A satisfies the following items (a1), (a2), and (a3). Therefore, the embodiment of FIG. 5A has the lamination symmetrical property in the orientation angle of the fiber.

(a1) The orientation angle of the fiber in the third layer s3 is substantially the same as that in the fourth layer s4.

(a2) The orientation angle of the fiber in the second layer s2 is substantially the same as that in the fifth layer s5.

(a3) The orientation angle of the fiber in the first layer s1 is substantially the same as that in the sixth layer s6.

On the other hand, when the number N of layers of the UD lamination part is odd, the neutral plane means a [(N/2)+1]-th layer itself. For example, as shown in FIG. 5B, when the number N of layers of the UD lamination part is 5, the neutral plane m1 is the third layer s3. The embodiment of FIG. 5B satisfies the following items (b1) and (b2). Therefore, the embodiment of FIG. 5B has the lamination symmetrical property in the orientation angle of the fiber.

(b1) The orientation angle of the fiber in the second layer s2 is substantially the same as that in the fourth layer s4.

(b2) The orientation angle of the fiber in the first layer s1 is substantially the same as that in the fifth layer s5.

In the orientation angle of the fiber, the term "substantially" has a purpose of allowing an error of ±10 degrees (preferably ±5 degrees). Usually, the outer surface of the head 2 is formed by a free curved surface, and is not a plane. For this reason, an error is inevitably generated in some extent in the orientation angle of the fiber.

The lamination symmetrical property in the orientation angle of the fiber is described above. The lamination symmetrical property in the other specification is also similarly defined. For example, when the number N of layers of the UD lamination part is 6, the UD lamination part satisfying the following items (a4), (a5), and (a6) has the lamination symmetrical property in the layer thickness.

(a4) The layer thickness in the third layer s3 is substantially the same as that in the fourth layer s4.

(a5) The layer thickness in the second layer s2 is substantially the same as that in the fifth layer s5.

(a6) The layer thickness in the first layer s1 is substantially the same as that in the sixth layer s6.

In the layer thickness, the term "substantially" has a purpose of allowing an error of ±10% (preferably ±5%). Usually, the matrix resin partially flows in the molding process of the UD lamination part 18. For this reason, an error is inevitably generated in some extent in the layer thickness.

Similarly, when the number N of layers of the UD lamination part is, for example, 6, the UD lamination part satisfying the following items (a7), (a8), and (a9) has the lamination symmetrical property in the prepreg kind.

(a7) The kind of the prepreg used in the third layer s3 is the same as that used in the fourth layer s4.

(a8) The kind of the prepreg used in the second layer s2 is the same as that used in the fifth layer s5.

(a9) The kind of the prepreg used in the first layer s1 is the same as that used in the sixth layer s6.

The kind of the prepreg can be distinguished by the part number of the prepreg.

The orientation angle of the fiber is notated by the numerical value in the present application. In order to facilitate the understanding, the following rules are defined to notate the orientation angle θ in the present application (see FIG. 4).

[Rule 1]: The orientation angle of the fiber is determined in a plan view from the crown side.

[Rule 2]: The inclination angle of 45 degrees to the face-back direction FB is defined as a reference direction X1. The reference direction X1 is defined as 0 degree.

[Rule 3]: A clockwise rotation direction viewed from the crown side is defined as plus, and a counterclockwise rotation direction viewed from the crown side is defined as minus.

The orientation angle θ has an allowable range of ±10 degree (preferably ±5 degrees).

As shown in FIG. 4, in the CFRP member 16, the orientation angle θ of the first layer s1 is 60 degrees (+60 degrees). The orientation angle θ of the second layer s2 is −60 degrees. The orientation angle θ of the third layer s3 is 0 degree. The orientation angle θ of the fourth layer s4 is 0 degree. The orientation angle θ of the fifth layer s5 is −60 degrees. The orientation angle θ of the sixth layer s6 is 60 degrees. The orientation angle θ of the seventh layer s7 is 0 degree and 45 degrees.

Therefore, the UD lamination part 18 has the lamination symmetrical property in the orientation angle of the fiber.

In the UD lamination part 18, the kind of the prepreg used in the third layer s3 is the same as that used in the fourth layer s4. The kind of the prepreg used in the second layer s2 is the same as that used in the fifth layer s5. The kind of the prepreg used in the first layer s1 is the same as that used in the sixth layer s6. Therefore, the UD lamination part 18 has the lamination symmetrical property in the prepreg kind. When the kind of the prepreg is the same, the layer thickness is the same; the carbon fiber kind is also the same; and the fiber content (% by mass) is also the same. Therefore, the UD lamination part 18 has the lamination symmetrical property in the layer thickness. The UD lamination part 18 has the lamination symmetrical property in the carbon fiber kind. The UD lamination part 18 has the lamination symmetrical property in the fiber content.

As described above, in the UD lamination part 18, the orientation of the fiber is −60 degrees (±10 degrees), 0 degree (±10 degrees), and 60 degrees (±10 degrees). That is, in the UD lamination part 18, the orientation of the fiber is substantially set to three directions.

The three directions are defined as a first direction, a second direction, and a third direction. In the UD lamination part 18, the angle of the second direction to the first direction is +60 degrees (±10 degrees). Furthermore, the angle of the third direction to the first direction is −60 degree (±10 degrees). In the UD lamination part 18, a fiber oriented in a direction other than the three directions does not exist.

It was found that the UD lamination part 18 having the fiber substantially oriented in the three directions can exhibit an advantageous effect as compared with the cases of the two direction and the four directions. It was found that the orientation in the three directions is advantageous for improvement in a hitting sound. The effect is shown in examples to be described later.

One of the objects of the use of the CFRP member 16 is to create an excess weight. Therefore, the lighter CFRP member 16 is desired. In order to achieve a reduction in a weight, the number of layers is limited. The improvement in the hitting sound is desired in the limited number of layers. The disposal of the fiber in the three directions can effectively improve the hitting sound under a condition where the number of layers is limited.

Furthermore, it was found that the lamination symmetrical property is advantageous to increase the natural frequency of the head. The lamination symmetrical property is advantageous to improve the hitting sound. The detailed reason is unknown.

The effect of the lamination symmetrical property is shown in examples to be described later.

The number of layers of the UD lamination part 18 is not limited. In respect of setting the fiber to the three directions, the number of layers of the UD lamination part 18 is set to be equal to or greater than 3. In respect of increasing the frequency of the hitting sound, the number of layers of the UD lamination part 18 is preferably equal to or greater than 5, and more preferably equal to or greater than 6. In respect of the reduction in the weight, the number of layers of the UD lamination part 18 is preferably equal to or less than 12, more preferably equal to or less than 9, and still more preferably equal to or less than 7.

In respect of increasing the frequency of the hitting sound, the thickness of the UD lamination part 18 is preferably equal to or greater than 0.5 mm, and more preferably equal to or greater than 0.6 mm. In respect of the reduction in the weight, the thickness of the UD lamination part 18 is preferably equal to or less than 0.9 mm, and more preferably equal to or less than 0.8 mm.

In respect of the increasing the frequency of the hitting sound, the thickness (total thickness) of the CFRP member is preferably equal to or greater than 0.5 mm, and more preferably equal to or greater than 0.6 mm. In respect of the reduction in the weight, the thickness of the CFRP member is preferably equal to or less than 0.9 mm, and more preferably equal to or less than 0.8 mm.

The excess weight is caused by use of the CFRP member. The excess weight improves a degree of freedom in design of the head. More preferably, the CFRP member is used in order to lower a position of a center of gravity of the head. A high launch angle and a low backspin rate can be achieved by lowering the position of the center of gravity of the head. The low position of the center of gravity can contribute to an increase in a flight distance. In this respect, the position of a center of gravity of the CFRP member is preferably above the position of the center of gravity of the whole head. Preferred examples of the disposal of the CFRP member include the following disposals A to D.

[Disposal A]: The CFRP member constitutes a part of the crown.

[Disposal B]: The CFRP member constitutes the whole crown.

[Disposal C]: The CFRP member constitutes a part of the crown and a part of the side.

[Disposal D]: The CFRP member constitutes the whole crown and a part of the side.

The CFRP single part described above greatly contributes to the creation of the excess weight. In other words, the CFRP single part greatly contributes to the movement of the position of the center of gravity. In this respect, the following disposals E to H are more preferable.

[Disposal E]: The CFRP single part constitutes a part of the crown.

[Disposal F]: The CFRP single part constitutes the whole crown.

[Disposal G]: The CFRP single part constitutes a part of the crown and a part of the side.

[Disposal H]: The CFRP single part constitutes the whole crown and a part of the side.

In respect of lowering the center of gravity of the head, it is preferable that the CFRP member does not constitute the sole.

The CFRP member is used, and thereby the improvement in the hitting sound is achieved. Furthermore, the CFRP member is used, and thereby a weight of the head can be suppressed while a volume of the head and a moment of inertia of the head are increased. In this respect, the volume of the head is preferably equal to or greater than 400 cc. In respects of a reduction in air resistance and ease to address, the volume of the head is preferably equal to or less than 500 cc, more preferably equal to or less than 470 cc, and still more preferably equal to or less than 460 cc. The weight of the head can be suppressed to be equal to or less than 200 g by the CFRP member having the constitution described above. In respect of durability, the weight of the head is preferably equal to or greater than 100 g, and more preferably equal to or greater than 150 g.

In respect of the directional stability of a hitting ball, the lateral moment of inertia (lateral MI) of the head is preferably equal to or greater than 4600 $g \cdot cm^2$, more preferably equal to or greater than 5000 $g \cdot cm^2$, and still more preferably equal to or greater than 5500 $g \cdot cm^2$. There is no need for limiting the lateral MI on performance. However, the lateral MI may be limited to be equal to or less than 8000 $g \cdot cm^2$ in consideration of a material and a structure which are used, and may be further limited to be equal to or less than 7000 $g \cdot cm^2$.

A Z axis is considered in measurement (calculation) of the lateral MI. The Z axis is an axis line perpendicular to the level surface h in the head in the base state. The lateral MI is a moment of inertia around an axis passing through the center of gravity of the head and being parallel to the Z axis.

The cloth layer 20 may be used and may not be used. The cloth layer 20 can improve formability. During the forming of the CFRP member, wrinkles may be generated in each layer. The cloth layer 20 can suppress the generation of the wrinkles. In respect of obtaining the effect, the cloth layer 20 is preferably provided in the outermost layer and/or the innermost layer, and more preferably provided in the outermost layer.

In the manufacturing process of the head, the surface of the CFRP member is usually polished. The cloth layer 20 provided in the outermost layer prevents the outer layer in the UD lamination part 18 from being polished. When the outer layer of the UD lamination part 18 is polished, the lamination symmetrical property of the UD lamination part 18 is lost. Even when the surface is polished, the lamination symmetrical property of the UD lamination part 18 is maintained by the existence of the cloth layer 20. The cloth layer 20 provided in the outermost layer is useful to smooth the surface after being polished. The smoothness can improve the aesthetic appearance of the head. In these respects, the cloth layer 20 is preferably provided in the outermost layer.

In respect of enhancing these effects, and in respect of a cost reduction, the cloth layer 20 preferably has two-directional fibers oriented to be different by 90 degrees from each other.

As shown in examples to be described later, it was found that the influence of the orientation of the fiber in the cloth layer 20 is small. The orientation of the fiber in the UD lamination part 18 is important. In this respect, the orientation of the fiber in the cloth layer 20 is not limited.

In respect of suppressing the weight, the number of layers of the cloth layer 20 is preferably equal to or less than 2, and more preferably 1.

The tensile elastic modulus of the carbon fiber used for the CFRP member is not limited. In respect of a balance between strength and rigidity, the tensile elastic modulus is preferably 23.5 (tonf/mm$^2$) or greater and 40 (tonf/mm$^2$) or less.

Examples of the prepreg usable as a material of the CFRP member are shown in Table 1.

TABLE 1

Examples of prepregs capable of being used

| Manufacturer | Part number of prepreg | Thickness of sheet (mm) | Fiber content (% by mass) | Resin content (% by mass) | Physical property value of carbon fiber: Part number of carbon fiber | Tensile elastic modulus (tonf/mm$^2$) | Tensile strength (kgf/mm$^2$) |
|---|---|---|---|---|---|---|---|
| Toray Industries, Inc. | 3255S-10 | 0.082 | 76 | 24 | T700S | 23.5 | 500 |
| Toray Industries, Inc. | 3255S-12 | 0.103 | 76 | 24 | T700S | 23.5 | 500 |
| Toray Industries, Inc. | 3255S-15 | 0.123 | 76 | 24 | T700S | 23.5 | 500 |
| Toray Industries, Inc. | 805S-3 | 0.034 | 60 | 40 | M30S | 30 | 560 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Nippon Graphite Fiber Corporation | E1026A-09N | 0.100 | 63 | 37 | XN-10 | 10 | 190 |
| Mitsubishi Rayon Co., Ltd. | TR350C-100S | 0.083 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | MR350C-075S | 0.063 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MR350C-125S | 0.105 | 75 | 25 | MR40 | 30 | 450 |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

A tensile strength and a tensile elastic modulus are values measured in accordance with JIS R7601: 1986 "Testing Method for Carbon Fibers"

As described above, the three directions are set to the first direction, the second direction, and the third direction. Herein, the number of the layers in which the direction of the fiber is the first direction is defined as N1. The number of the layers in which the direction of the fiber is the second direction is defined as N2. The number of the layers in which the direction of the fiber is the third direction is defined as N3. N1 is an integer equal to or greater than 1. N2 is an integer equal to or greater than 1. N3 is an integer equal to or greater than 1.

In respect of the reduction in the weight, N1 is preferably equal to or less than 4, and more preferably equal to or less than 3. Similarly, N2 is preferably equal to or less than 4, and more preferably equal to or less than 3. Similarly, N3 is preferably equal to or less than 4, and more preferably equal to or less than 3.

The maximum value of N1, N2, and N3 is defined as Nmax, and the minimum value of N1, N2, and N3 is defined as Nmin. In respect of the lamination symmetrical property, a difference (Nmax−Nmin) is preferably equal to or less than 1, and particularly preferably 0.

Preferably, the natural mode and the natural frequency of the head are considered. The hitting sound of the head using the CFRP member can be effectively improved by considering the natural mode and the natural frequency of the head.

The following terms are used in the present application.

[Natural Mode]

All objects have a natural form when the objects vibrate. The natural form is a natural mode. The natural mode of the head (whole head) is considered in the present application. The natural mode of the head is associated with the hitting sound.

"The natural mode" of the present application is a natural mode of the head. When "the natural mode" is merely described in the present application, "the natural mode" means the natural mode of the whole head. When "the natural mode of the head" is described in the present application, "the natural mode of the head" means the natural mode of the whole head.

A method for obtaining the natural mode is not limited. A mode test (also referred to as experiment mode analysis) or mode analysis can be used. In the mode test, an excitation experiment is conducted and the natural mode is obtained based on the result of the experiment. In the mode analysis, the natural mode is obtained by simulation. In the simulation, for example, a finite element method may be used. The methods of the mode test and the mode analysis are known.

The mode test or the mode analysis is conducted under a free support condition. That is, a constraint condition is made free. In the mode analysis, for example, commercially available natural value analyzing software is used. Examples of the software include "ABAQUS" (trade name) (manufactured by SIMULIA), "MARC" (trade name) (manufactured by MSC Software Corporation) and "NX" (manufactured by Siemens PLM Solutions).

In examples to be described later, the mode analysis using the natural value analyzing software is conducted. On the other hand, the mode test by actual measurement, for example, is executed as follows. A thread is fixed to a region of the head (for example, an end face of a neck). Each of parts of the head is struck by an impact hammer in a state where the head is hung with the thread. The mode is obtained by measuring a transfer function with acceleration response of a center of a face.

[Natural Frequency]

"The natural frequency" of the present application is a natural frequency of the head. When "the natural frequency" is merely described in the present application, "the natural frequency" means the natural frequency of the whole head.

[N-th Order Natural Frequency]

"The N-th order natural frequency" of the present application is "an N-th natural frequency counted from the smallest natural frequency among the natural frequencies in the whole head". N is an integer equal to or greater than 1. A rigidity mode in which the head is not deformed is not counted as the order. For example, "a first-order natural frequency" is "a first-order natural frequency in the whole head". For example, "a second-order natural frequency" is "a second-order natural frequency in the whole head". When "the N-th order natural frequency" is merely described in the present application, "the N-th order natural frequency" means the N-th order natural frequency in the whole head.

[N-th Order Mode]

"The N-th order mode" of the present application is "an N-th order natural mode in the whole head". N is an integer equal to or greater than 1. For example, "a first-order mode" is "a first-order natural mode in the whole head". For example, "a second-order mode" is "a second-order natural mode in the whole head". When "the N-th order mode" is merely described in the present application, "the N-th order mode" means the N-th order natural mode in the whole head.

"The first-order natural frequency" is the smallest natural frequency among the natural frequencies of the head. "The second-order natural frequency" is a second natural frequency from the smallest natural frequency. "The third-order natural frequency" is a third natural frequency from the smallest natural frequency. "The N-th order natural frequency" is an N-th natural frequency from the smallest natural frequency. The increase of "the first-order natural frequency" is considered to be most effective in making the higher-pitch hitting sound. The lower order tends to greatly affect the hitting sound.

[Order of Head]

The order of the head means the order of the natural mode in the whole head.

[Maximum Amplitude Point]

In the N-th order natural mode, a point having the greatest amplitude is a maximum amplitude point. The maximum amplitude point is ordinarily set at one place per each order natural mode. For example, a maximum amplitude point Pm1 in the first-order mode is ordinarily set at one place. Similarly, a maximum amplitude point Pm2 in the second-order mode is ordinarily set at one place. The maximum amplitude point Pm1 is a point having the greatest amplitude in the first-order mode. The maximum amplitude point Pm2 is a point having the greatest amplitude in the second-order mode.

It is considered that the hitting sound is one of the important performances of a golf club. In order to improve the hitting sound, in examples to be described later, vibration in a region in which the CFRP member is provided is analyzed. The CFRP member has a damping ratio greater than that of a metal such as a titanium alloy. The greater damping ratio shortens the sound of the hitting ball. The CFRP member tends to reduce the frequency of the hitting sound as compared with the metal such as a titanium alloy. A longer and higher-pitch hitting sound is desired.

The provision of the CFRP member tends to reduce the frequency of the hitting sound, and shorten the hitting sound. In order to improve the hitting sound, the vibration in the region in which the CFRP member is provided is preferably analyzed. The analysis is shown in examples to be described later.

The present invention can improve the hitting sound. Therefore, the present invention is preferably applied to a head having a loud hitting sound. In this respect, a hollow head is preferable, and the thickness of the head is preferably reduced. In respect of the volume of the hitting sound, the average thickness Ts of the sole is preferably equal to or less than 1.5 mm, more preferably equal to or less than 1.2 mm, still more preferably equal to or less than 1.0 mm, and yet still more preferably equal to or less than 0.8 mm. In respect of the strength of the head, the average thickness Ts of the sole is preferably equal to or greater than 0.5 mm. In respect of the volume of the hitting sound, the average thickness Tc of the crown is preferably equal to or less than 1.2 mm, more preferably equal to or less than 1.0 mm, still more preferably equal to or less than 0.8 mm, and yet still more preferably equal to or less than 0.7 mm. In respect of the strength of the head, the average thickness Tc of the crown is preferably equal to or greater than 0.4 mm.

In respect of the pitch of the hitting sound, the material of the head body h1 is preferably a metal. Examples of the metal include one or more kinds of metals selected from pure titanium, a titanium alloy, stainless steel, maraging steel, an aluminium alloy, a magnesium alloy, and a tungsten-nickel alloy. Examples of the stainless steel include SUS630 and SUS304. Specific examples of the stainless steel include CUSTOM450 (manufactured by Carpenter Technology Corporation). Specific examples of the titanium alloy include 6-4 titanium (Ti-6A1-4V), and Ti-15V-3Cr-3Sn-3A1. When the volume of the head is great, the hitting sound tends to be loud. The present invention is particularly effective in the head having a loud hitting sound. In this respect, the material of the head body h1 is particularly preferably the titanium alloy. In this respect, the materials of the sole and side are preferably the titanium alloy.

EXAMPLES

Hereinafter, the effects of the present invention will be clarified by examples. However, the present invention should not be interpreted in a limited way based on the description of the examples.

[Preparation of Simulation Head Data]

Figure 6:
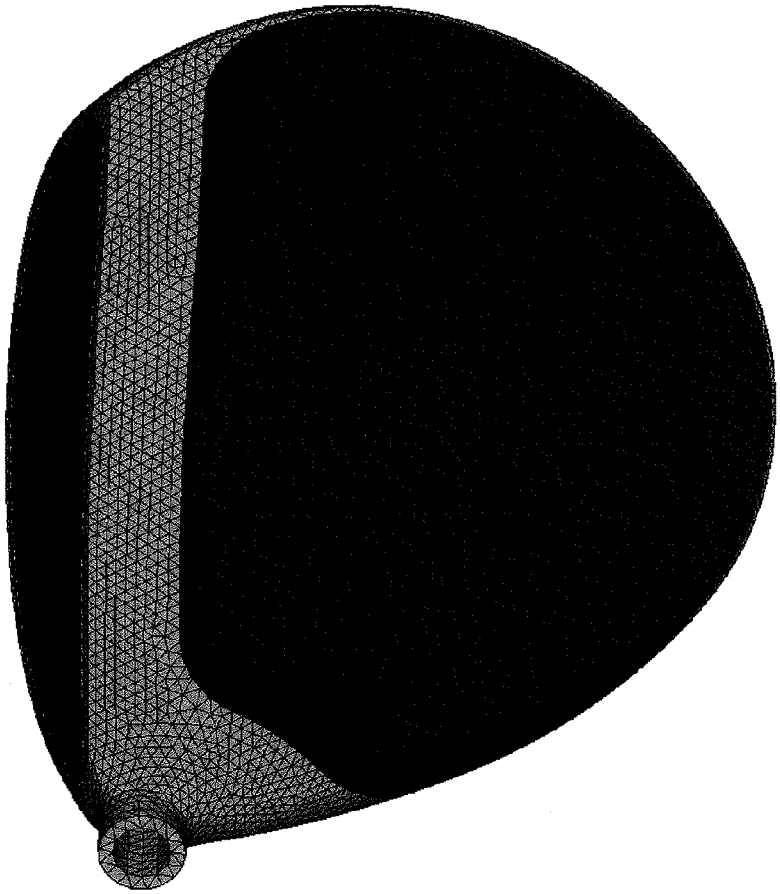
FIG. 6 is a simulation image showing a plan view of the head, and a CFRP member 16 is shown in black in FIG. 6.
Figure 7:
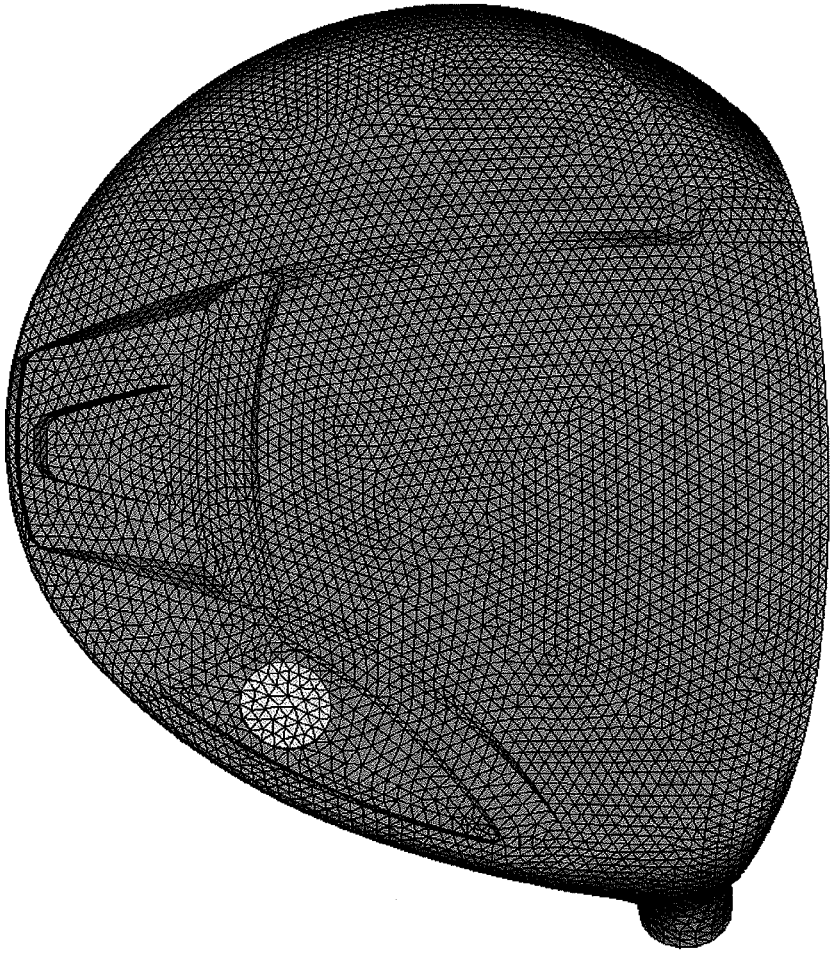
FIG. 7 is a simulation image showing a bottom view of the head.
Figure 8:
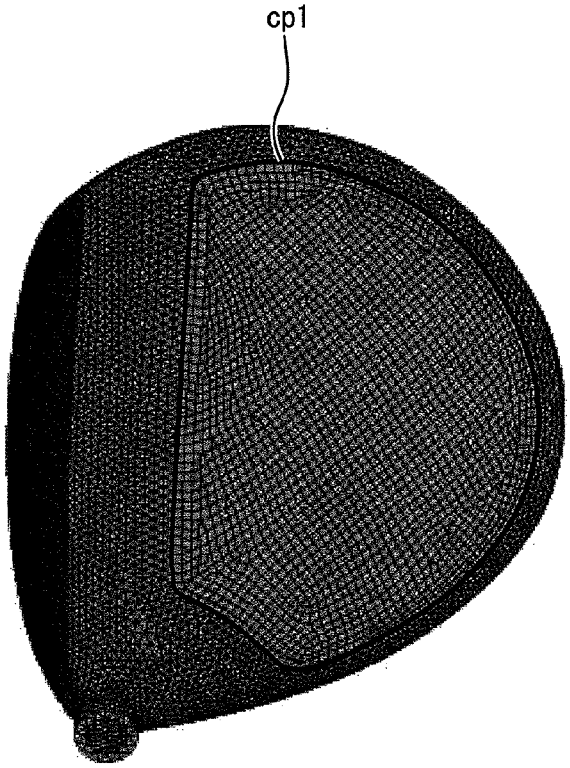
FIG. 8 is a simulation image showing a plan view of the head, and the position of a crown opening cp1 is shown in FIG. 8.

The three-dimensional data of a head shown in FIGS. 1 and 2 was prepared. The volume of the head was set to 449 cc, and the weight of the head was set to 178 g. The head was mesh-divided into a finite element using a commercially available preprocessor (HyperMesh or the like) to obtain a calculation model. FIG. 6 is a plan view of the mesh-divided head. FIG. 7 is a bottom view of the mesh-divided head. A portion painted in black in a crown of FIG. 6 shows a CFRP member. FIG. 8 is a plan view of the mesh-divided head as in FIG. 6. Unlike FIG. 6, in FIG. 8, the CFRP member is not painted in black. In FIG. 8, the position of the crown opening cp1 is shown by a thick line. The inner side of the crown opening cp1 is the CFRP single part.

The crown opening cp1 (see FIG. 8) is located inside the contour line of the CFRP member (see FIG. 6). A region between the contour line of the CFRP member and the crown opening cp1 is the overlapped part a1 (not shown) described above.

Natural value analysis was conducted using the head to calculate a natural frequency and a mode shape. Natural value analyzing software was used for the natural value analysis. "NASTRAN" manufactured by MSC Software was used as the software. A boundary condition was set to free support (no restraint).

The laminated constitution of the CFRP member was variously changed using the head data thus prepared, to conduct simulation (natural value analysis). The thickness of each layer was equalized in all the following calculation models. That is, the thickness of each layer was set to a value obtained by dividing the thickness of the CFRP member by the number of layers.

The following physical values were used in the simulation. In a layer having a fiber elastic modulus of 24 (tonf/mm$^2$), an elastic modulus in a lengthwise direction was set to 142 GPa; a poisson ratio was set to 0.32; an elastic modulus in a crosswise direction was set to 8.8 GPa; and an in-plane shearing elastic modulus was set to 4.2 GPa. In a layer having a fiber elastic modulus of 30 (tonf/mm$^2$), an elastic modulus in a lengthwise direction was set to 168 GPa; a poisson ratio was set to 0.31; an elastic modulus in a crosswise direction was set to 7.9 GPa; and an in-plane shearing elastic modulus was set to 4.1 GPa. In a layer having a fiber elastic modulus of 40 (tonf/mm$^2$), an elastic modulus in a lengthwise direction was set to 228 GPa; a poisson ratio was set to 0.26; an elastic modulus in a crosswise direction was set to 7.2 GPa; and an in-plane shearing elastic modulus was set to 4.1 GPa. The lengthwise direction means a direction parallel to fiber orientation. The crosswise direction means a direction perpendicular to the fiber orientation.

Three kinds of simulations were executed in order to confirm the effects of the present invention in detail. Simulation A, simulation B, and simulation C will be described in this order.

[Simulation A]

Heads (calculation models) A1 to A16 were obtained by changing the specification of the CFRP member. The first-order natural frequencies of the heads were calculated. As the first-order natural frequency is higher, a hitting sound tends to have higher-pitch. As first-order natural frequency is higher, it can be said that the result is good.

[Head A1]

The specification of the CFRP member in the head A1 was as follows. The specification of the head A1 is shown also in the following Table 2.

the elastic modulus of a fiber: 24 (tonf/mm$^2$)

the total number of layers: 6 the number of layers of a UD lamination part: 6 the number of layers of a cloth layer: 0 the total thickness of the CFRP member: 0.76 mm the orientation angles of the fibers (in order from the inner layer): 90 degrees/0 degree/90 degrees/30 degrees/150 degrees/90 degrees

[Head A2 to A16]

The number of layers of the UD lamination part was set to 6 in the heads A2 to A10. The number was set to 8 in the head A11. The number was set to 10 in the head A12. The number was set to 5 in the heads A13 to A16. The specifications of the heads are shown in the following Table 2.

TABLE 2

Specification of CFRP member in simulation A

| Head | Fiber elastic modulus | Number of lamination layers | Thickness of CFRP member (mm) | Angle θ first layer (innermost layer) | Angle θ second layer | Angle θ third layer | Angle θ fourth layer | Angle θ fifth layer | Angle θ sixth layer | Angle θ seventh layer | Angle θ eighth layer | Angle θ ninth layer | Angle θ tenth layer | Lamination symmetrical property |
|---|---|---|---|---|---|---|---|---|---|---|---|---|---|---|
| A1 | 24t | 6 | 0.76 | 90 | 0 | 90 | 30 | 150 | 90 | | | | | Absence |
| A2 | 24t | 6 | 0.76 | 90 | 30 | 150 | 150 | 30 | 90 | | | | | Presence |
| A3 | 24t | 6 | 0.76 | 90 | 30 | 150 | 90 | 30 | 150 | | | | | Absence |
| A4 | 24t | 6 | 0.76 | 30 | 150 | 90 | 90 | 150 | 30 | | | | | Presence |
| A5 | 24t | 6 | 0.76 | 30 | 150 | 90 | 30 | 150 | 90 | | | | | Absence |
| A6 | 24t | 6 | 0.76 | 240 | 0 | 120 | 120 | 0 | 240 | | | | | Presence |
| A7 | 24t | 6 | 0.76 | 240 | 0 | 120 | 240 | 0 | 120 | | | | | Absence |
| A8 | 24t | 6 | 0.76 | 45 | −45 | 45 | −45 | 45 | −45 | | | | | Absence |
| A9 | 30t | 6 | 0.76 | 45 | −45 | 45 | −45 | 45 | −45 | | | | | Absence |
| A10 | 40t | 6 | 0.76 | 45 | −45 | 45 | −45 | 45 | −45 | | | | | Absence |
| A11 | 24t | 8 | 1.01 | 45 | −45 | 45 | −45 | 45 | −45 | 45 | −45 | | | Absence |
| A12 | 24t | 10 | 1.26 | 45 | −45 | 45 | −45 | 45 | −45 | 45 | −45 | 45 | −45 | Absence |
| A13 | 24t | 5 | 0.63 | 45 | −45 | 0 | 45 | −45 | | | | | | Absence |
| A14 | 24t | 5 | 0.63 | 60 | −60 | 0 | 60 | −60 | | | | | | Absence |
| A15 | 24t | 5 | 0.63 | 45 | −45 | 0 | −45 | 45 | | | | | | Presence |
| A16 | 24t | 5 | 0.63 | 60 | −60 | 0 | −60 | 60 | | | | | | Presence |

The calculation results of the first-order natural frequencies in the heads are as follows.

Figure 9:
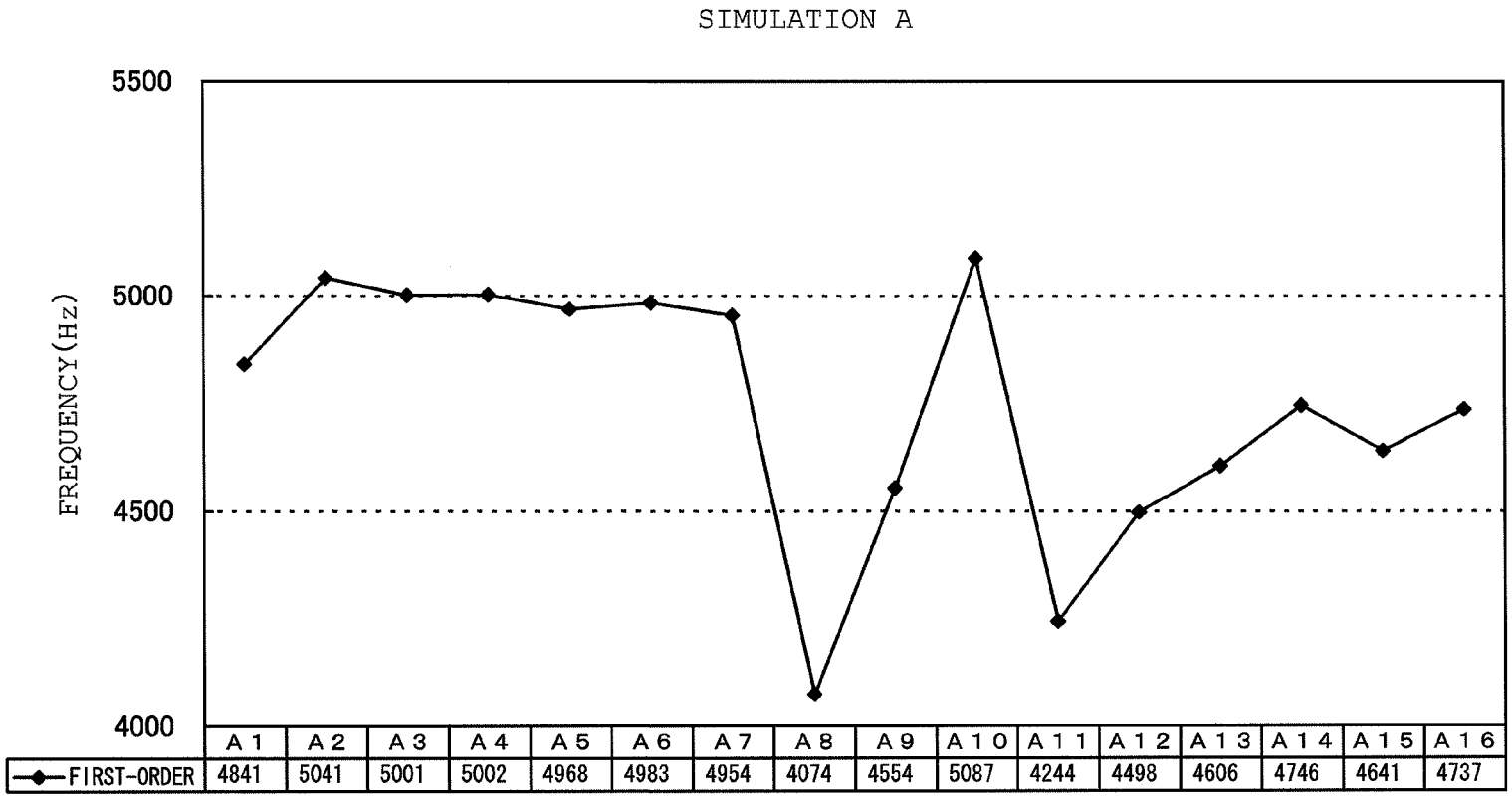
FIG. 9 is a graph showing the calculation result of a first-order natural frequency in simulation A.
Figure 10:
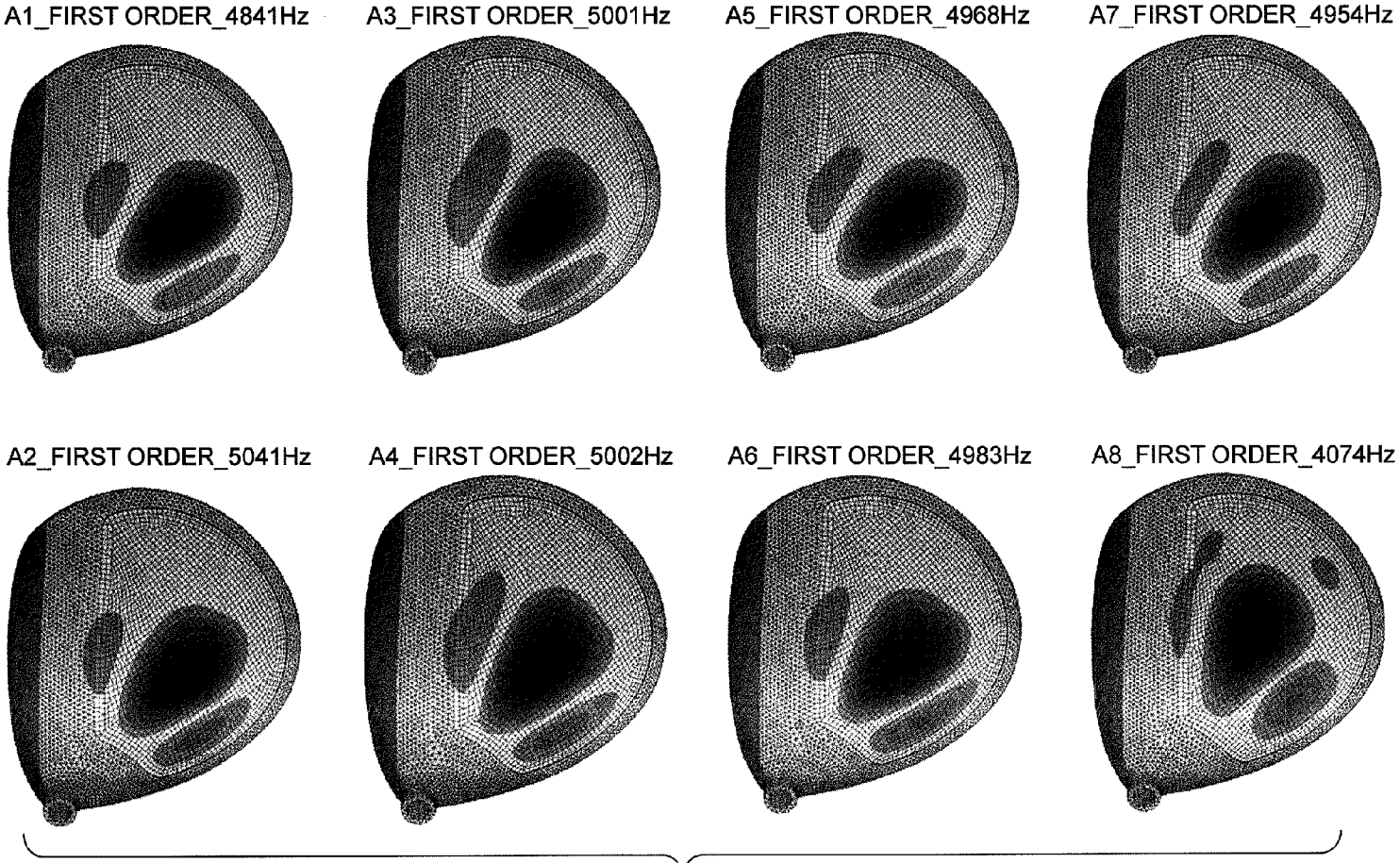
FIG. 10 is a simulation image showing a vibration form in a first-order mode, and heads A1 to A8 are shown in FIG. 10.
Figure 11:
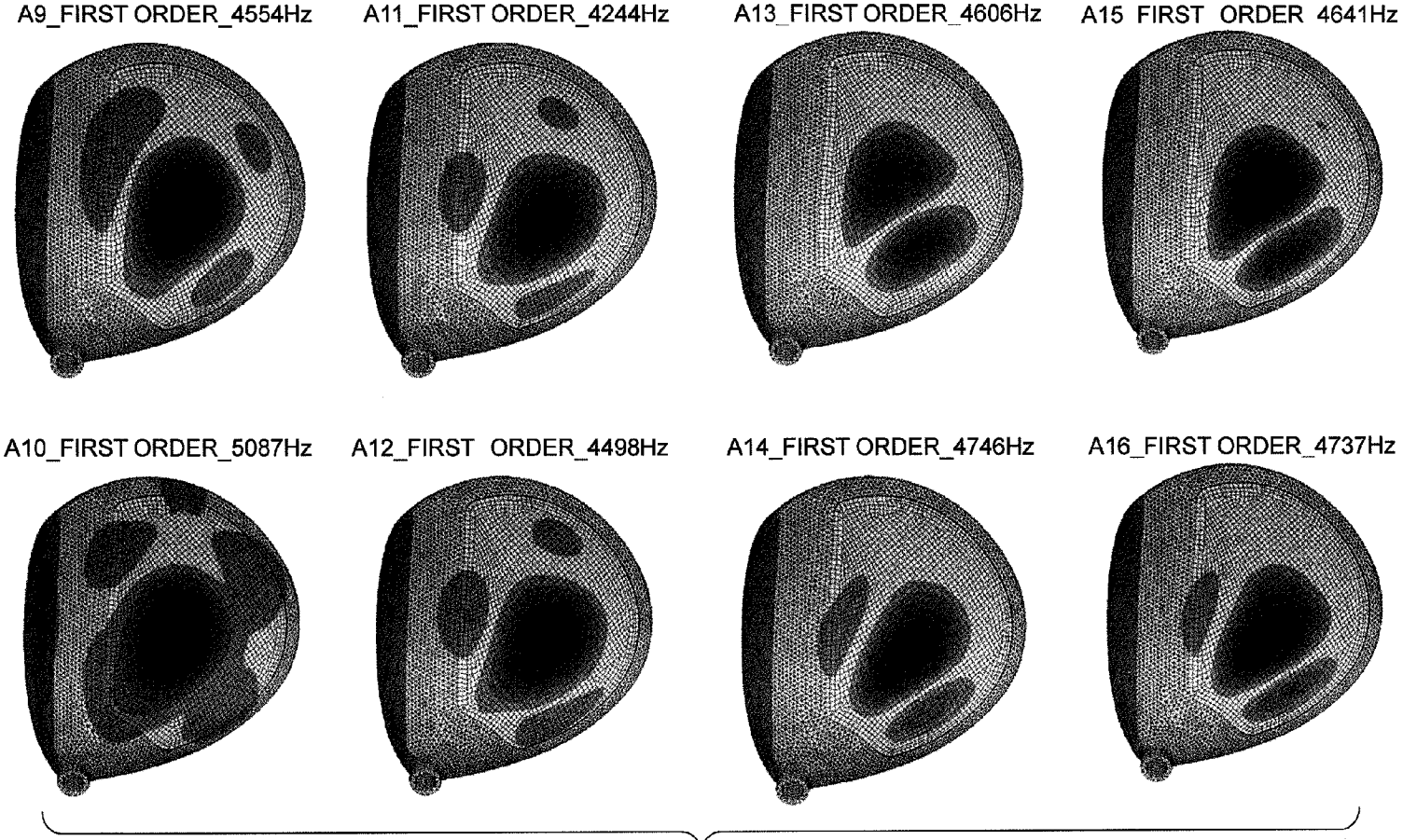
FIG. 11 is a simulation image showing a vibration form in a first-order mode, and heads A9 to A16 are shown in FIG. 10.

[Head A1]: 4841 Hz
[Head A2]: 5041 Hz
[Head A3]: 5001 Hz
[Head A4]: 5002 Hz
[Head A5]: 4968 Hz
[Head A6]: 4983 Hz
[Head A7]: 4954 Hz
[Head A8]: 4074 Hz
[Head A9]: 4554 Hz
[Head A10]: 5087 Hz
[Head A11]: 4244 Hz
[Head A12]: 4498 Hz
[Head A13]: 4606 Hz
[Head A14]: 4746 Hz
[Head A15]: 4641 Hz
[Head A16]: 4737 Hz FIG. 9 is a graph in which the first-order natural frequencies of the heads A1 to A16 are plotted. FIGS. 10 and 11 are simulation images showing vibrations in the first-order modes of the heads A1 to A16. FIG. 10 shows the heads A1 to A8. FIG. 11 shows the heads A9 to A16. In these simulation images, a deeper portion has a greater amplitude.

In FIGS. 10 and 11, the central part of the deepest portion is a maximum amplitude point Pm1 in the first-order mode. The maximum amplitude point Pm1 is located in the CFRP single part in each head. However, the position of the maximum amplitude point Pm1 varies depending on the head.

As shown in FIG. 9, the difference between the first-order natural frequencies was observed. The difference shows the effect of the present invention. The effect will be described later.

In the heads A1 to A8, the specification of the CFRP member is common except for the orientation of the fiber. When the first-order natural frequencies of the heads A1 to A8 are compared with each other, the head A8 has the lowest first-order natural frequency, and the head A1 has the next lower the first-order natural frequency. The heads A2 to A7 have a comparatively high first-order natural frequency. The orientation of the fiber of the head A8 is set two directions. The orientation of the fiber of the head A1 is set to four directions. On the other hand, the orientation of the fiber of the heads A2 to A7 is set to three directions. From the result, the advantage of the orientation of the fiber set to three directions is shown.

The head A2 and the head A3 are the same except the order of the lamination. The head A2 has a lamination symmetrical property in the orientation angle of the fiber. However, the head A3 does not have the lamination symmetrical property. When both the heads A2 and A3 are compared with each other, the head A2 has a higher first-order natural frequency. This shows the advantage of the lamination symmetrical property. Similarly, the advantage of the lamination symmetrical property is shown in comparison of the head A4 with the head A5. Similarly, the advantage of the lamination symmetrical property is shown in comparison of the head A6 with the head A7.

In the heads A8 to A10, only the tensile elastic modulus of the fiber is different. As the tensile elastic modulus is greater, the first-order natural frequency is higher.

The number of layers is increased in the heads A11 and A12, and the thickness of the CFRP member is also great. Nevertheless, the first-order natural frequencies of the heads A11 and A12 are lower than those of the heads A2 to A7. The result also shows the advantage of the orientation of the fiber set to three directions.

In the heads A13 to A16, the number of layers is 5. The head A13 and the head A15 are the same except for the order of the lamination. The head A15 has a lamination symmetrical property in the orientation angle of the fiber. However, the head A13 does not have the lamination symmetrical property. When both the heads A13 and A15 are compared with each other, the head A15 has a higher first-order natural frequency. This shows the advantage of the lamination symmetrical property. Similarly, the advantage of the lamination symmetrical property is shown in comparison of the head A14 with the head A16.

[Simulation B]

In the simulation B, the relative relation of the fiber angle between lamination layers was fixed, and the influence of the absolute value of the orientation angle was considered. First, the following two kinds of lamination patterns Bx and By were determined. In the lamination pattern Bx, the orientation of the fiber was set to two directions. In the lamination pattern By, the orientation of the fiber was set to three directions. The number of layers of each pattern was 6.

[Lamination Pattern Bx]: The angles of the layers of the CFRP member were 0 degree/90 degrees/0 degree/90 degrees/90 degrees/0 degree in order from the inner side.

[Lamination Pattern By]: The angles of the layers of the CFRP member were 0 degree/−60 degrees/−120 degrees/0 degree/−60 degrees/−120 degrees in order from the inner side.

In each of the lamination patterns Bx and By, the thicknesses of the layers were set to 0.1 mm/0.1 mm/0.15 mm/0.15 mm/0.1 mm/0.1 mm in order from the inner side.

Heads Bx1 to Bx7 in which a relative relation of a fiber angle was the same as that of the pattern Bx were prepared.

[Head Bx1]: An orientation angle of a fiber of an innermost layer is −45 degrees.

[Head Bx2]: An orientation angle of a fiber of an innermost layer is −30 degrees.

[Head Bx3]: An orientation angle of a fiber of an innermost layer is −15 degrees.

[Head Bx4]: An orientation angle of a fiber of an innermost layer is 0 degree.

[Head Bx5]: An orientation angle of a fiber of an innermost layer is 15 degrees.

[Head Bx6]: An orientation angle of a fiber of an innermost layer is 30 degrees.

[Head Bx7]: An orientation angle of a fiber of an innermost layer is 45 degrees.

That is, these heads Bx1 to Bx7 can be obtained by rotating the lamination pattern Bx.

Similarly, heads By1 to By7 in which a relative relation of a fiber angle was the same as that of the pattern By were prepared.

[Head By1]: An orientation angle of a fiber of an innermost layer is −45 degrees.

[Head By2]: An orientation angle of a fiber of an innermost layer is −30 degrees.

[Head By3]: An orientation angle of a fiber of an innermost layer is −15 degrees.

[Head By4]: An orientation angle of a fiber of an innermost layer is 0 degree.

[Head By5]: An orientation angle of a fiber of an innermost layer is 15 degrees.

[Head By6]: An orientation angle of a fiber of an innermost layer is 30 degrees.

[Head By7]: An orientation angle of a fiber of an innermost layer is 45 degrees.

That is, these heads By1 to By7 can be obtained by rotating the lamination pattern By.

In the simulation B, lowest order Dc when the maximum amplitude point was located in the crown was determined. A natural frequency fm in the lowest order Dc was calculated. For example, when a maximum amplitude point Pmt in the first-order mode is located in a sole; a maximum amplitude point Pm2 in a second-order mode is also located in the sole; a maximum amplitude point Pm3 in a third-order mode is also located in the sole; and a maximum amplitude point Pm4 in a fourth-order mode is located in a crown, the lowest order Dc is fourth-order. The natural frequency fm in the lowest order Dc is a fourth-order natural frequency. In the present application, the lowest order Dc is referred to as crown first-order. The natural frequency fm is referred to as a crown first-order natural frequency.

The natural frequency fm in the lowest order Dc reflects vibration in a region (crown) in which the CFRP member exists. The natural frequency fm shows the relationship between the hitting sound and the CFRP member.

The natural frequencies fm in the heads were as follows.

[Two Directions]

[Head Bx1]: 3660 Hz

[Head Bx2]: 3744 Hz

[Head Bx3]: 3786 Hz

Figure 12:
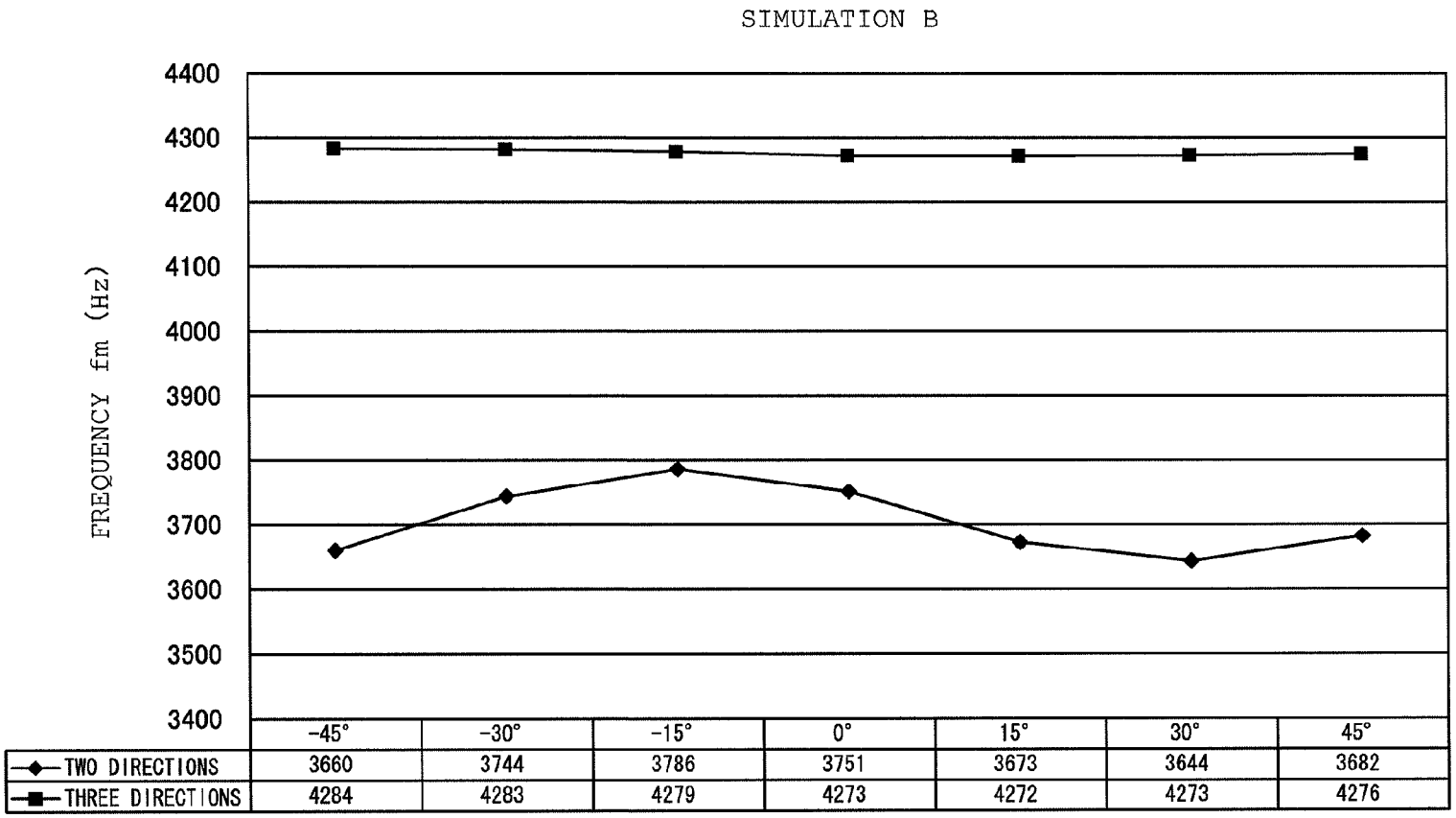
FIG. 12 is a graph showing the calculation result of a natural frequency fm (a natural frequency in a first-order mode of a crown) in simulation B.

[Head Bx4]: 3751 Hz
[Head Bx5]: 3673 Hz
[Head Bx6]: 3644 Hz
[Head Bx7]: 3682 Hz
[Three Directions]
[Head By1]: 4284 Hz
[Head By2]: 4283 Hz
[Head By3]: 4279 Hz
[Head By4]: 4273 Hz
[Head By5]: 4272 Hz
[Head By6]: 4273 Hz
[Head By7]: 4276 Hz FIG. 12 is a graph in which the natural frequencies fm are plotted. As shown in FIG. 12, in the heads By1 to By7 in which the orientation of the fiber was set to three directions, the difference between the maximum value and the minimum value of the natural frequency fm was 12 Hz. That is, it was found that the natural frequency fm is less influenced by the absolute value of the orientation of the fiber when the orientation of the fiber is set to three directions. On the other hand, in the heads Bx1 to Bx7 in which the orientation of the fiber is set to two directions, the difference between the maximum value and the minimum value of the natural frequency fm was 142 Hz. That is, it was found that the natural frequency fm is apt to be influenced by the absolute value of the orientation of the fiber when the orientation of the fiber is set to two directions. Even if the orientation of the fiber is fluctuated by a manufacture error or the like when the orientation of the fiber is set to three directions, the natural frequency fm has little variation. Therefore, a stable hitting sound tends to be obtained.

Furthermore, as shown in FIG. 12, when the orientation of the fiber is set to three directions, a high natural frequency fm tends to be obtained. Therefore, the frequency of the hitting sound tends to be increased.

Figure 13:
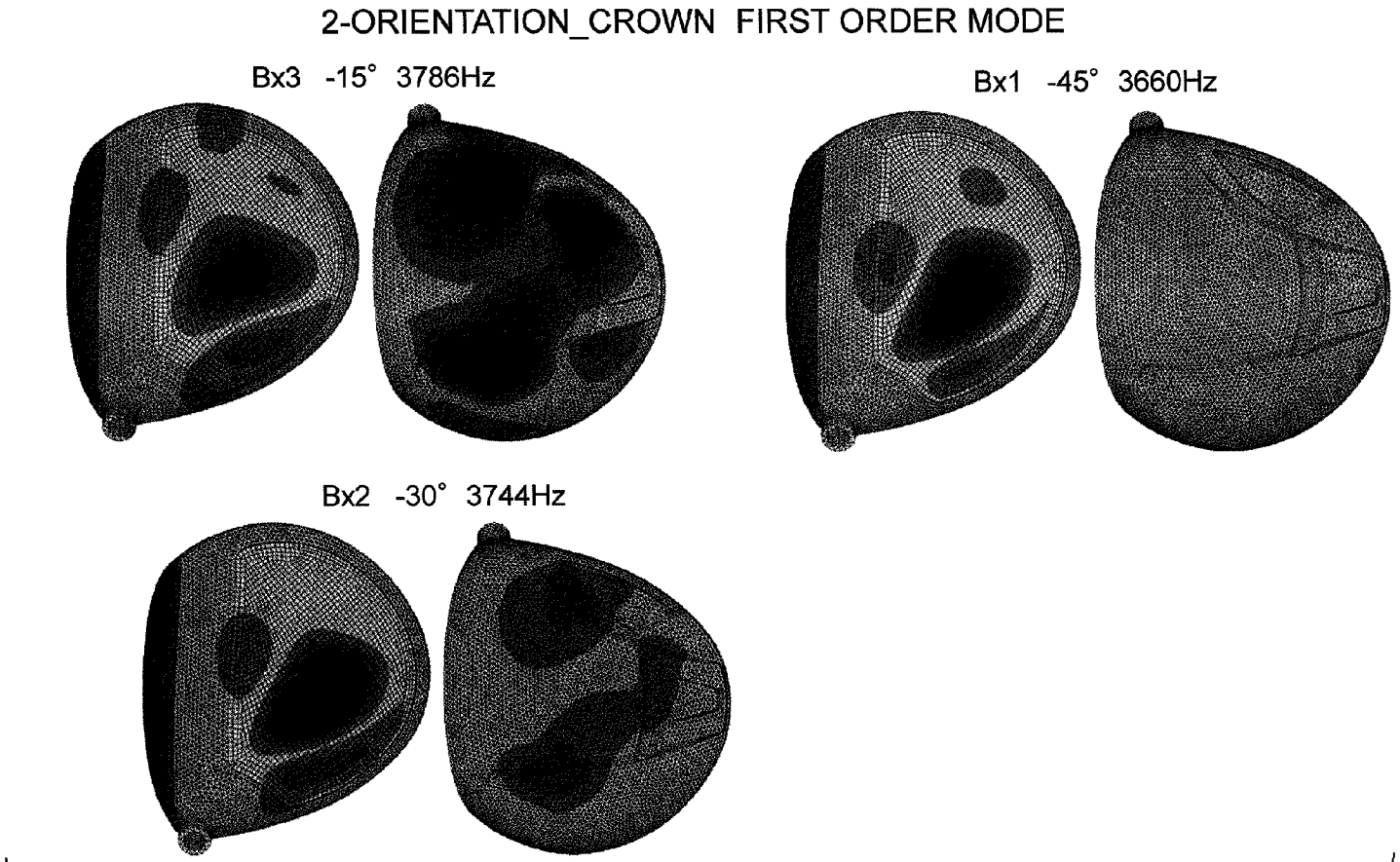
FIG. 13 is a simulation image showing a vibration form in a first-order mode of a crown, and heads Bx1 to Bx3 are shown in FIG. 13.
Figure 14:
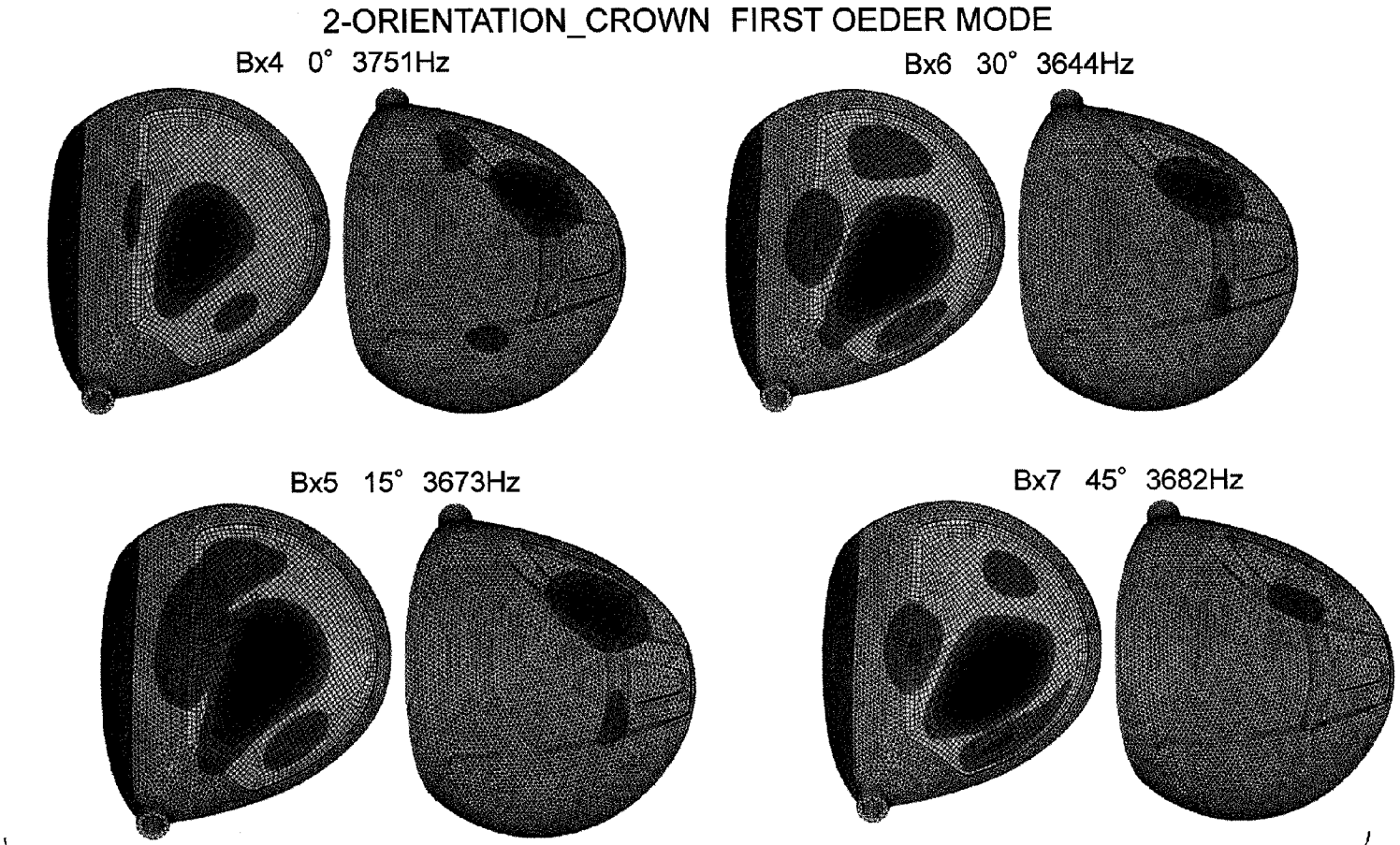
FIG. 14 is a simulation image showing a vibration form in a first-order mode of a crown, and heads Bx4 to Bx7 are shown in FIG. 14.
Figure 15:
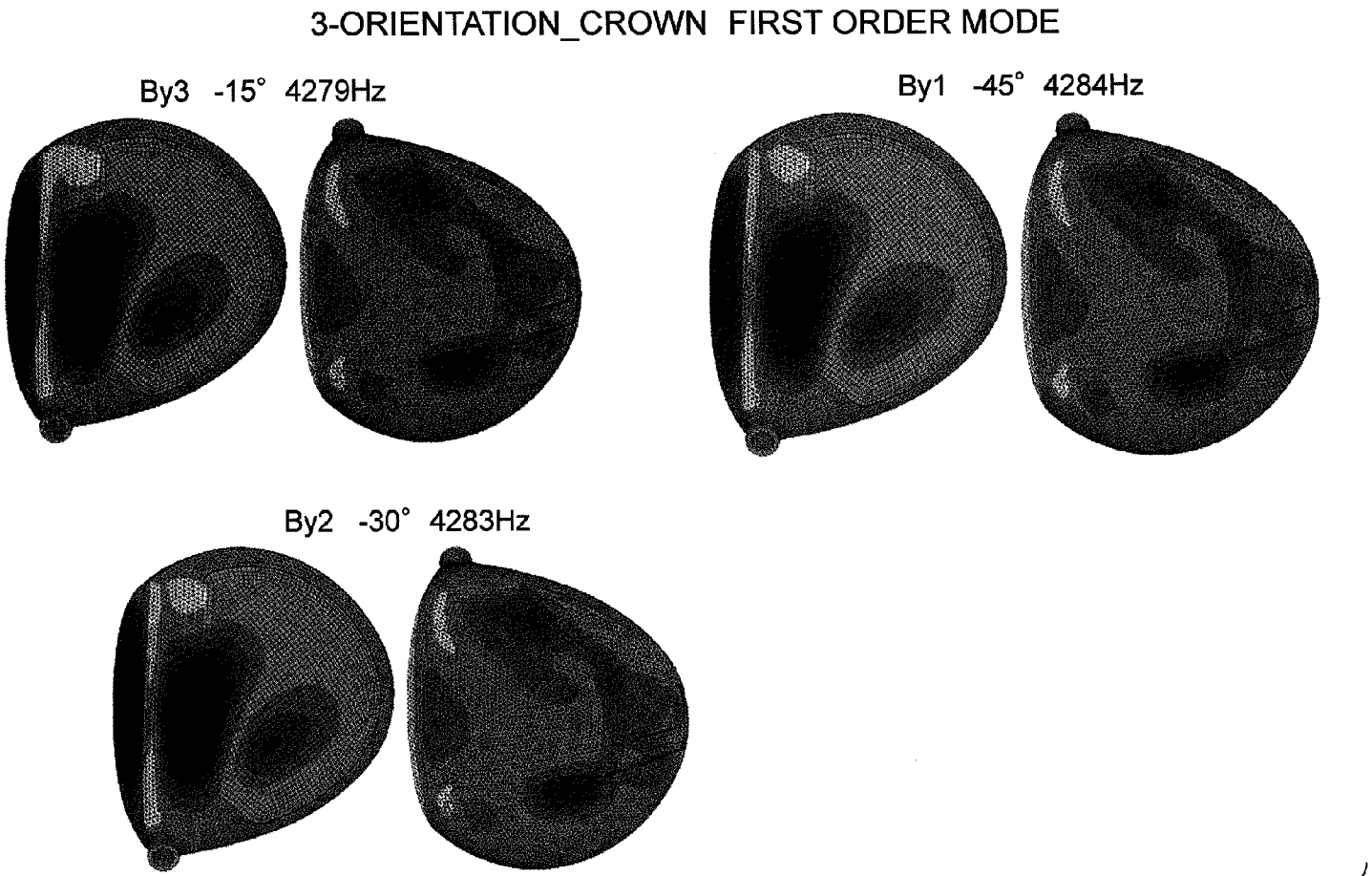
FIG. 15 is a simulation image showing a vibration form in a first-order mode of a crown, and heads By1 to By3 are shown in FIG. 15.
Figure 16:
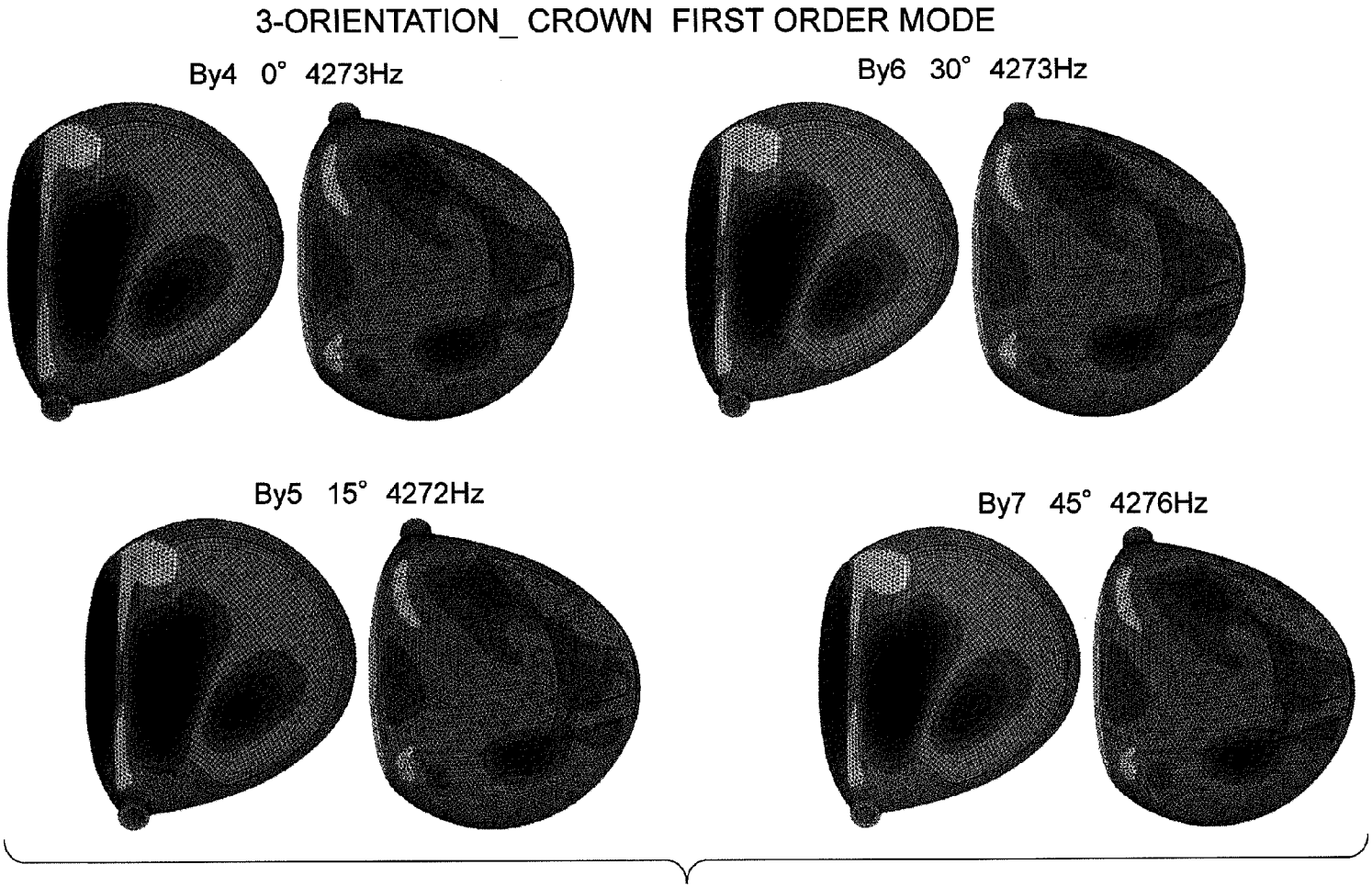
FIG. 16 is a simulation image showing a vibration form in a first-order mode of a crown, and heads By4 to By7 are shown in FIG. 16.

FIGS. 13 to 16 are simulation images showing vibration forms in the lowest order Dc (crown first-order). FIG. 13 shows the images of the heads Bx1, Bx2, and Bx3. FIG. 14 shows the images of the heads Bx4, Bx5, Bx6, and Bx7. FIG. 15 shows the images of the heads By1, By2, and By3. FIG. 16 shows the images of the heads By4, By5, By6, and By7. A deeper portion has a greater amplitude.

As shown in FIGS. 13 and 14, in the heads Bx1 to Bx7, the maximum amplitude point in the crown first-order mode is located in the CFRP single part. On the other hand, in the heads By1 to By7, the maximum amplitude point in the crown first-order mode is not located in the CFRP single part. In the heads By1 to By7, the maximum amplitude point in the crown first-order mode is located in an overlapped part a1 or a metal single part. The metal single part is a portion made of only a metal. The metal has a damping rate smaller than that of CFRP. The maximum amplitude point in the crown first-order mode is separated from the CFRP single part, and thereby the hitting sound is lengthened. The maximum amplitude point in the crown first-order mode is separated from the CFRP single part, and thereby the frequency of the hitting sound is increased. In these respects, the maximum amplitude point in the crown first-order mode is preferably separated from the CFRP single part. When the images of the heads Bx1 to Bx7 and the images of the heads By1 to By7 are compared with each other, the maximum amplitude point in the crown first-order mode is greatly moved. The movement of the maximum amplitude point shows a remarkable effect when the orientation of the fiber is set to three directions. In respect of the hitting sound, the maximum amplitude point in the crown first-order mode is most preferably located in the metal single part.

The metal single part of the embodiment is a titanium single part. The titanium single part is a portion made of only a titanium alloy.

[Simulation C]

In the simulation C, the influence of the cloth layer was considered. The natural frequency fm of a head in which an outermost layer is the cloth layer was calculated.

[Head C1]

The specification of the CFRP member in the head C1 was as follows. The specification of the head C1 is shown also in the following Table 3.

the tensile elastic modulus of a fiber: 24 (tonf/mm$^2$)
the total number of layers: 7
the number of layers of a UD lamination part: 6
the number of layers of the cloth layer: 1
the position of the cloth layer: the outermost layer
the total thickness of the CFRP member: 0.70 mm
the orientation angles of the fibers (in order from the inner layer): 60 degrees/−60 degrees/0 degree/0 degree/−60 degrees/60 degrees/cross of 0 degree and 90 degrees For the sake of simplicity, the cloth layer was constituted by superposing two layers having a thickness which was half of that of a UD layer. The orientation angles of the fibers were made different by 90 degrees from each other in the two layers.

[Head C2 to C8]

The heads C2 to C8 were prepared in the same manner as in the head C1 except that the orientations of the UD layer and the cloth layer were changed as shown in the following Table 3. The specifications of these heads are shown in the following Table 3.

TABLE 3

Specification of CFRP member in simulation C

| Head | Fiber elastic modulus | Number of lamination layers | Thickness of CFRP member (mm) | Angle θ first layer (innermost layer) | Angle θ second layer | Angle θ third layer | Angle θ fourth layer | Angle θ fifth layer | Angle θ sixth layer | Angle θ seventh cloth layer | Lamination symmetrical property |
|---|---|---|---|---|---|---|---|---|---|---|---|
| C1 | 24t | 7 | 0.70 | 60 | −60 | 0 | 0 | −60 | 60 | 0/90 | Presence |
| C2 | 24t | 7 | 0.70 | 60 | −60 | 0 | 0 | −60 | 60 | −45/45 | Presence |
| C3 | 24t | 7 | 0.70 | 60 | −60 | 0 | 0 | −60 | 60 | 90/0 | Presence |
| C4 | 24t | 7 | 0.70 | 0 | −60 | 60 | 0 | −60 | 60 | 0/90 | Absence |
| C5 | 24t | 7 | 0.70 | 0 | −60 | 60 | 0 | −60 | 60 | −45/45 | Absence |
| C6 | 24t | 7 | 0.70 | 90 | 0 | 90 | 90 | 0 | 90 | 0/90 | Presence |
| C7 | 24t | 7 | 0.70 | 90 | 0 | 90 | 90 | 0 | 90 | 90/0 | Presence |
| C8 | 24t | 7 | 0.70 | 0 | 90 | 0 | 90 | 0 | 90 | 0/90 | Absence |

As the calculation result of the head C1, the first-order natural frequency was 3395 Hz; the second-order natural frequency was 3809 Hz; the third-order natural frequency was 3837 Hz; and the fourth-order natural frequency was 4277 Hz. In the head C1, a head fourth-order mode was the crown first-order mode.

The natural frequencies fm in the heads were as follows.

[Head C1]: 4277 Hz
[Head C2]: 4269 Hz
[Head C3]: 4279 Hz
[Head C4]: 4279 Hz
[Head C5]: 4269 Hz
[Head C6]: 3736 Hz
[Head C7]: 3739 Hz
[Head C8]: 3750 Hz As the order (the order in the whole head) of the head in the crown first-order mode, the orders of the heads C1 to C5 were fourth-order, and the orders of the heads C6 to C8 were second-order.

The order of the head in the crown first-order mode is associated with the frequency of sound caused by the vibration of the crown. The higher-pitch hitting sound caused by the vibration of the crown can be obtained by increasing the order of the head in the crown first-order mode. Therefore, even if the CFRP member is provided in the crown, the frequency of the hitting sound is hardly reduced. In this respect, the order of the head in the crown first-order mode is preferably equal to or greater than third-order, and more preferably equal to or greater than fourth-order.

Figure 17:
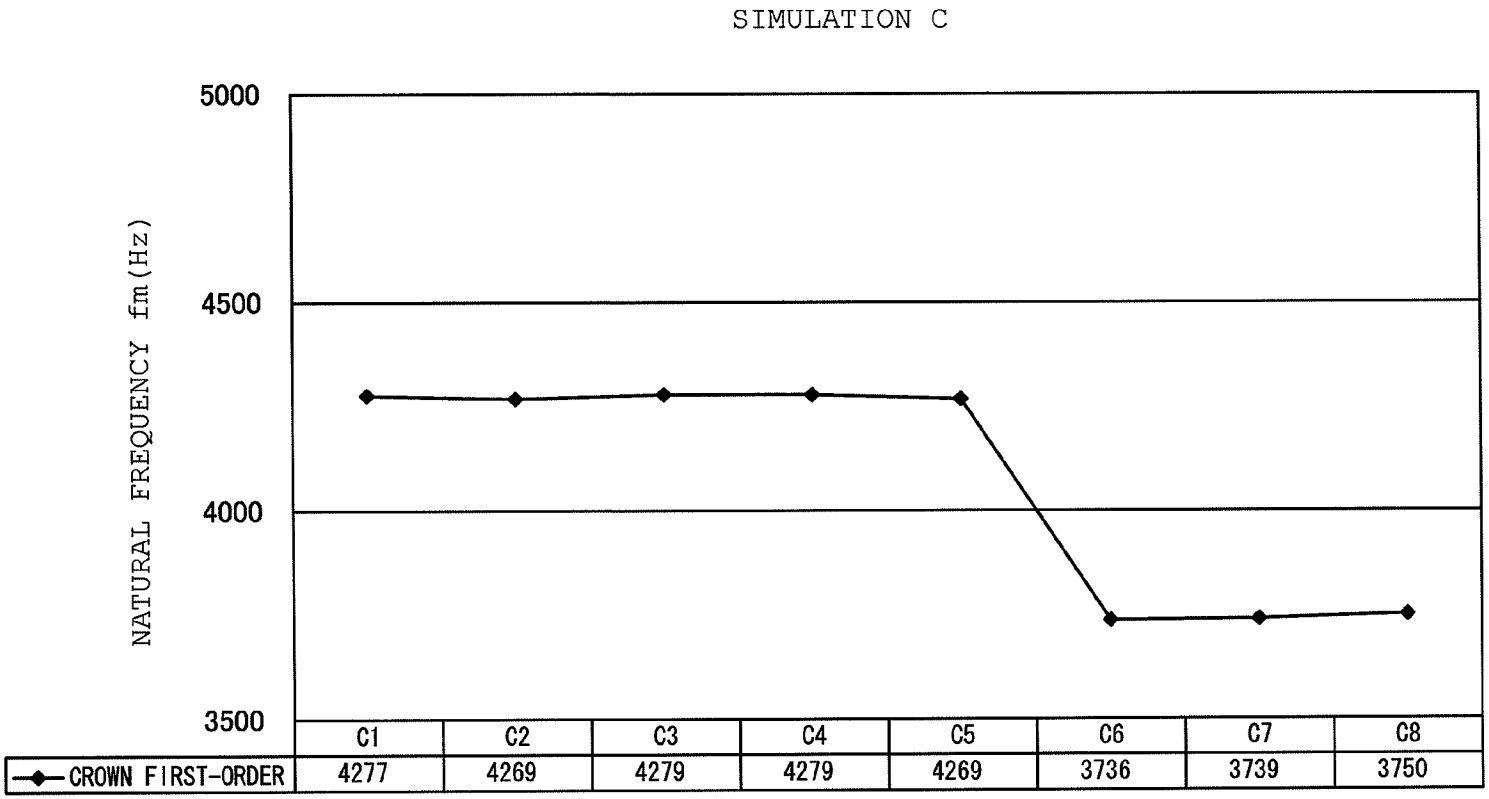
FIG. 17 is a graph showing the calculation result of a natural frequency fm (a natural frequency in a first-order mode of a crown) in simulation C.

FIG. 17 is a graph in which the natural frequencies fm of the heads C1 to C8 are plotted. As shown in the graph, in the heads C1 to C5, the natural frequency fm is almost the same. This shows that the influence of the orientation of the cloth layer is very small. That is, significance to focus attention on the UD lamination part is shown.

As shown in Table 3, in the heads C1 to C5, the orientation of the fiber in the UD lamination part is set to three directions. On the other hand, the orientation of the fiber in the UD lamination part is set to two directions in the heads C6 to C8. As shown in FIG. 17, the natural frequencies fm of the heads C1 to C5 are remarkably different from those of the heads C6 to C8. The heads C1 to C5 have a natural frequency fm higher than those of the heads C6 to C8. This result shows the advantage of the three directions.

Figure 18:
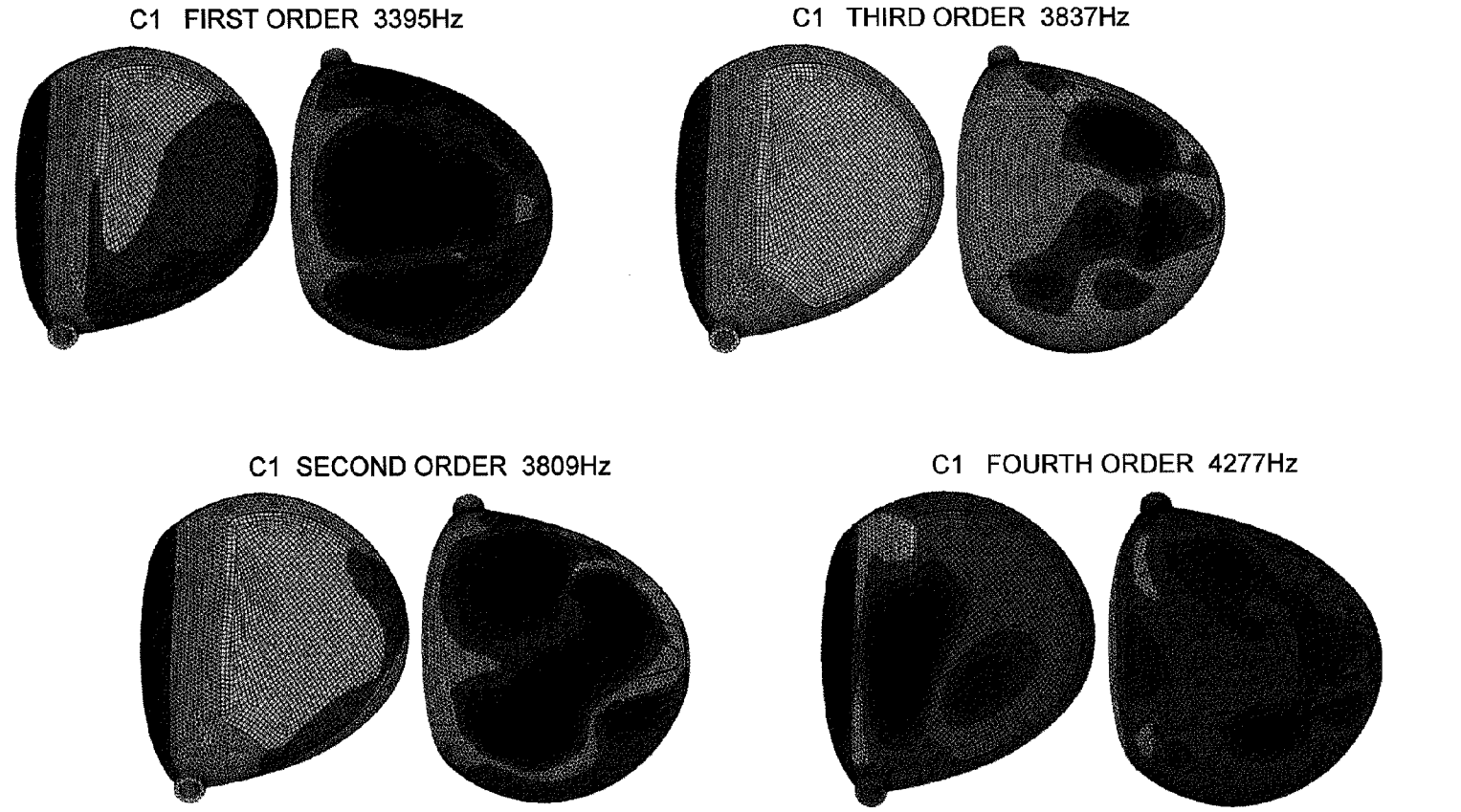
FIG. 18 is a simulation image showing the vibration form of a head C1 in a first-order mode, a second-order mode, a third-order mode, and a fourth-order mode.

FIG. 18 shows simulation images showing vibration forms of the first to fourth-orders in the head C1. As shown in FIG. 18, in the head C1, the crown first-order mode is the fourth-order mode.

Figure 19:
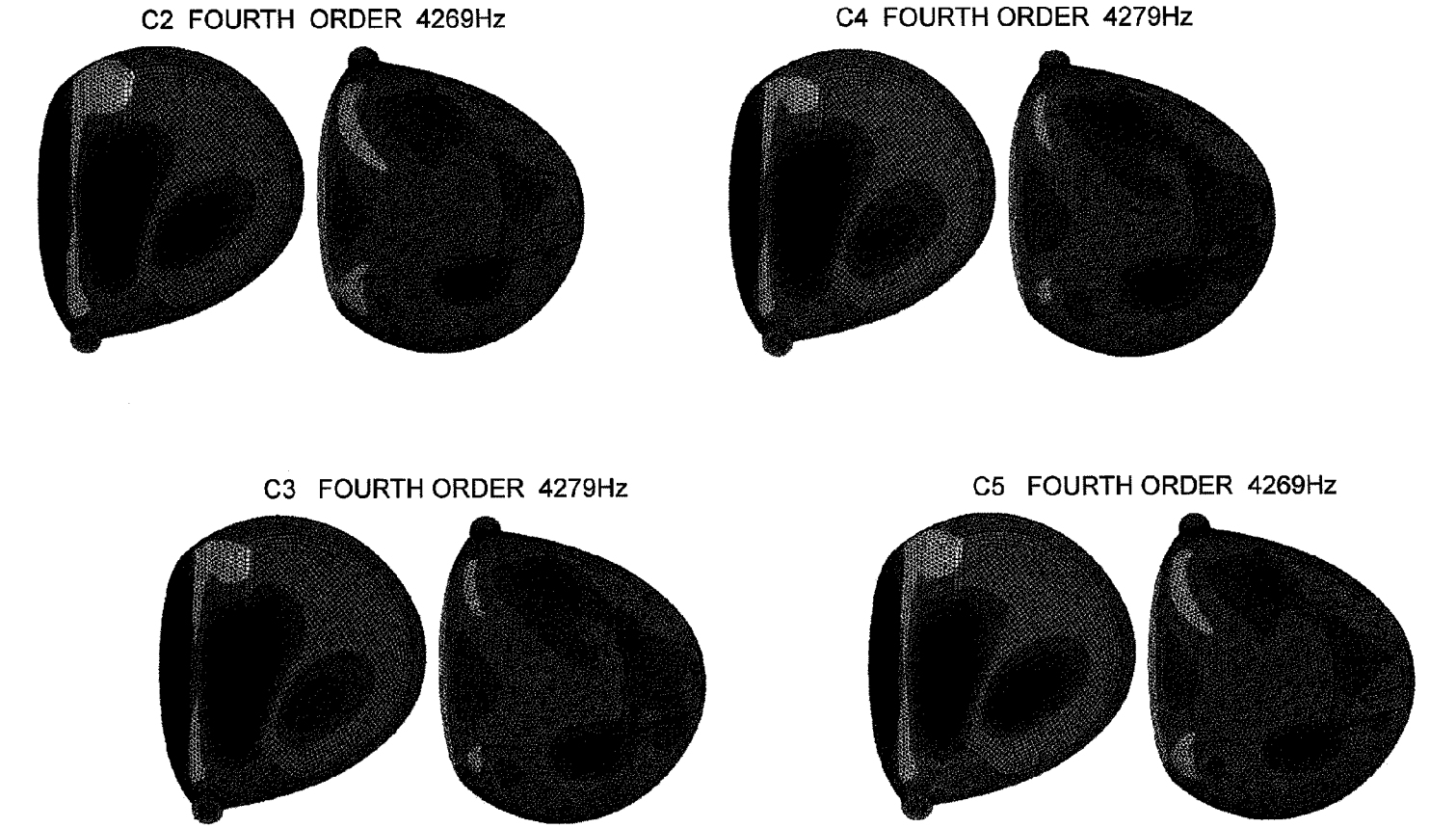
FIG. 19 is a simulation image showing a vibration form in a first-order mode of a crown, and heads C2 to C5 are shown in FIG. 19.
Figure 20:
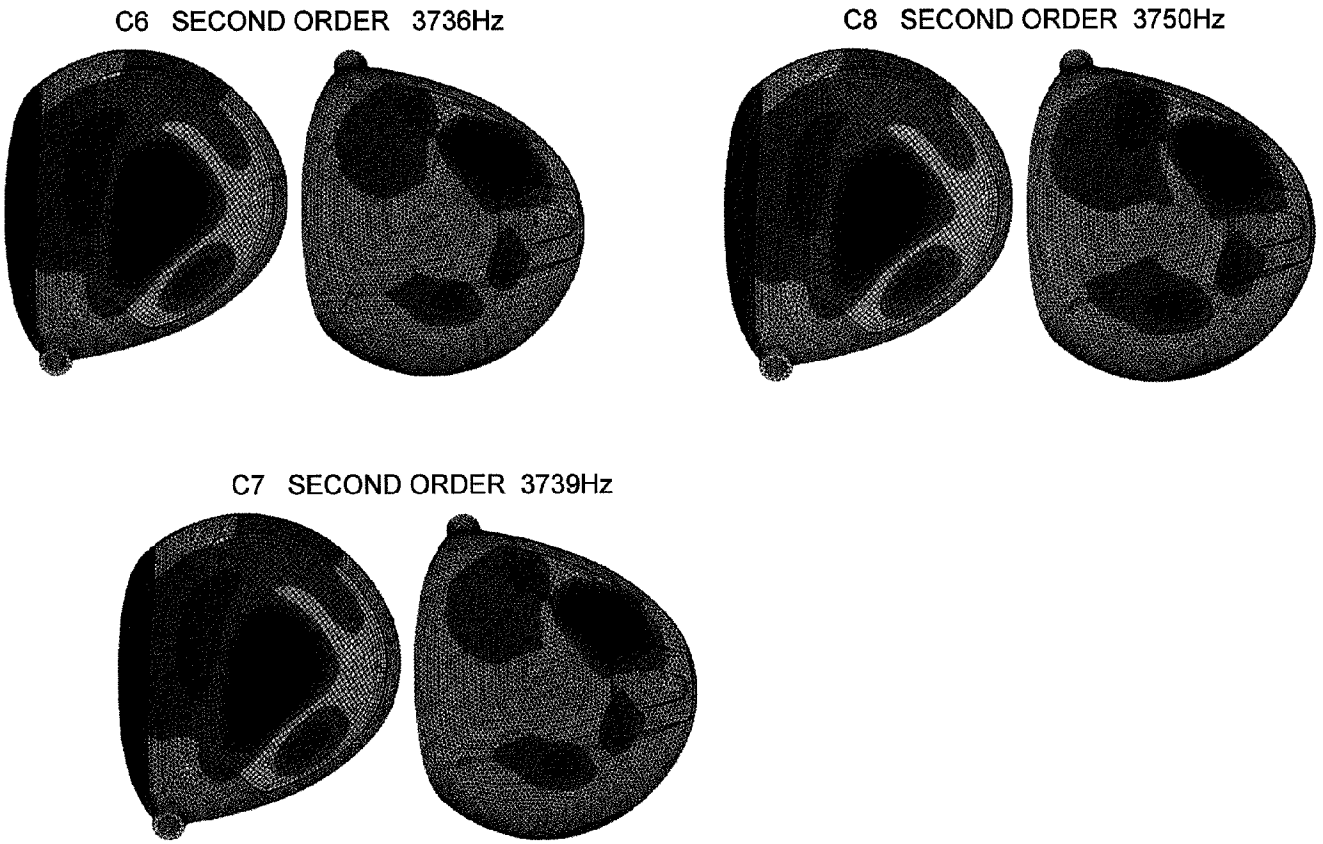
FIG. 20 is a simulation image showing a vibration form in a first-order mode of a crown, and heads C6 to C8 are shown in FIG. 20.

FIGS. 19 and 20 are simulation images showing vibration forms in the crown first-order mode. FIG. 19 shows the images of the heads C2, C3, C4, and C5. FIG. 20 shows the images of the heads C6, C7, and C8. A deeper portion has a greater amplitude.

As shown in FIGS. 18 and 19, in the heads C1 to C5, the maximum amplitude point in the crown first-order mode is not located in the CFRP single part. In the heads C1 to C5, the maximum amplitude point in the crown first-order mode is located in the overlapped part a1 or the metal single part. On the other hand, as shown in FIG. 20, in the heads C6 to C8, the maximum amplitude point in the crown first-order mode is located in the CFRP single part. Thus, the maximum amplitude point in the crown first-order mode is greatly moved by changing the orientation of the fiber to the three directions from the two directions. The movement increases the natural frequency fm. The movement is an example showing the effect of setting the orientation of the fiber to the three directions.

In respect of increasing the frequency of the hitting sound, the natural frequency fm is preferably equal to or greater than 3900 Hz, more preferably equal to or greater than 4000 Hz, and still more preferably equal to or greater than 4100 Hz.

As described above, the high effect is obtained by orienting the fiber in the three directions. Advantages of the present invention are apparent from these simulation results.

The method described above can be applied to all golf club heads.

The description hereinabove is merely for an illustrative example, and various modifications can be made in the scope not to depart from the principles of the present invention.

What is claimed is:

1. A golf club head comprising:
a head body; and
a carbon fiber reinforced plastic (CFRP) member,
wherein the CFRP member constitutes at least a part of a crown or at least a part of a sole,
wherein the CFRP member has a uni-direction (UD) lamination part having laminated UD layers,
wherein an orientation of a fiber is substantially set to three different angles in the UD lamination part,
wherein the UD lamination part has a neutral plane with at least one upper layer above the neutral plane and at least one lower layer below the neutral plane, and
wherein an orientation of fiber in an upper layer is substantially equal to an orientation of a lower layer a same number of layers from the neutral plane.

2. The golf club head according to claim 1, wherein when the three directions are a first direction, a second direction, and a third direction, an angle of the second direction to the first direction is substantially +60 degrees, and an angle of the third direction to the first direction is substantially −60 degrees.

3. The golf club head according to claim 1, wherein the number of layers of the UD lamination part is 5 or greater and 12 or less.

4. The golf club head according to claim 1, wherein the CFRP member constitutes at least a part of the crown.

5. The golf club head according to claim 1, wherein a volume of a head is equal to or greater than 400 cc; a weight of the head is equal to or less than 200 g; and a lateral moment of inertia is equal to or greater than 4600 $g \cdot cm^2$.

6. The golf club head according to claim 1, wherein the CFRP member has a CFRP single part; and
the CFRP single part constitutes at least a part of the crown.

7. The golf club head according to claim 1, wherein the CFRP member exists in at least a part of the crown, and is absent in the sole.

8. The golf club head according to claim 1, wherein a thickness of the UD lamination part is 0.5 mm or greater and 0.9 mm or less.

9. The golf club head according to claim 1, wherein a thickness of the CFRP member is 0.5 mm or greater and 0.9 mm or less.

10. The golf club head according to claim 1, wherein the UD lamination part has a lamination symmetrical property in a layer thickness.

11. The golf club head according to claim 6, wherein a maximum amplitude point in a first-order mode of the crown is not located in the CFRP single part.

12. The golf club head according to claim 1, wherein the UD lamination part has at least two upper layers above the neutral plane and at least two lower layer below the neutral plane.

13. The golf club head according to claim 1, wherein the orientation of fiber in an upper layer ±10 degrees to an orientation of a lower layer a same number of layers from the neutral plane.

* * * * *